US006095164A

United States Patent [19]

Saitoh et al.

[11] Patent Number: 6,095,164

[45] Date of Patent: Aug. 1, 2000

[54] METHOD AND APPARATUS FOR REMOVING IMAGE FORMING SUBSTANCE FROM IMAGE HOLDING MEMBER

[75] Inventors: Masatoshi Saitoh, Machida; Kazuhiro Ando, Satte; Tadashi Saitoh, Yokohama; Youichi Asaba; Kiyoshi Tanikawa, both of Yokohama; Yoshiaki Miyashita; Satoshi Shinguryo, both of Kawasaki; Shinichi Kuramoto, Numazu; Sadao Takahashi; Yoshiyuki Kimura, both of Tokyo, all of Japan

[73] Assignee: Ricoh Company, Ltd., Tokyo, Japan

[21] Appl. No.: 08/310,394

[22] Filed: Sep. 22, 1994

[30] Foreign Application Priority Data

| | | | |
|---|---|---|---|
| Sep. 22, 1993 | [JP] | Japan | 5-259270 |
| Dec. 29, 1993 | [JP] | Japan | 5-351908 |
| Aug. 26, 1994 | [JP] | Japan | 6-225670 |

[51] Int. Cl.[7] ..... B08B 3/04

[52] U.S. Cl. ..... 134/113; 134/201; 355/296; 355/256; 118/661; 118/662

[58] Field of Search ..... 355/296, 256; 134/113, 115, 201; 118/661, 662

[56] References Cited

U.S. PATENT DOCUMENTS

| | | |
|---|---|---|
| 207,626 | 9/1878 | Sargent . |
| 722,252 | 3/1903 | Richards . |
| 1,947,748 | 2/1934 | Van Wormer . |
| 2,207,966 | 7/1940 | Billings, Jr. . |
| 2,831,409 | 4/1958 | Bixby et al. . |
| 2,937,390 | 5/1960 | Bolton et al. . |
| 3,108,895 | 10/1963 | Howell . |
| 3,202,532 | 8/1965 | Labombarde . |
| 3,237,231 | 3/1966 | Zink . |
| 3,328,821 | 7/1967 | La Mura . |
| 3,448,720 | 6/1969 | Graham . |
| 3,598,487 | 8/1971 | Mizuguchi et al. . |
| 3,613,701 | 10/1971 | Ando . |
| 3,630,776 | 12/1971 | Barr . |
| 3,656,948 | 4/1972 | Mammino . |
| 3,776,631 | 12/1973 | Mammino . |
| 4,249,653 | 2/1981 | Kufferath-Kassner . |
| 4,252,882 | 2/1981 | Herrmann . |
| 4,388,391 | 6/1983 | Schell . |
| 4,392,742 | 7/1983 | Landa . |
| 4,482,241 | 11/1984 | Moraw et al. . |
| 4,504,995 | 3/1985 | Zippwald, Sr. . |
| 4,733,422 | 3/1988 | Schramm et al. . |

(List continued on next page.)

FOREIGN PATENT DOCUMENTS

| | | |
|---|---|---|
| 50-56942 | 5/1975 | Japan . |
| 51-100728 | 9/1976 | Japan . |

(List continued on next page.)

*Primary Examiner*—Frankie L. Stinson
*Attorney, Agent, or Firm*—Oblon, Spivak, McClelland, Maier & Neustadt, P.C.

[57] ABSTRACT

In a method and an apparatus for removing an image forming substance such as toner from an image holding member such as a sheet of transfer paper, a CCD sensor detects an unremoved image formed by a stamp, additional writing, etc. and left on the transfer paper sheet after toner separating processing is performed with respect to the transfer paper sheet by a liquid-providing toner-separating unit. A discriminating mark such as a punch, a mark o, etc. is additionally provided to the transfer paper sheet having the detected unremoved image by a discriminating mark providing unit. The transfer paper sheet having the discriminating mark is automatically sorted by a sorting unit and is discharged onto a paper discharging tray. The toner removing apparatus may have an unrecognizing device for blotting the unremoved image such as a seal print, a signature, etc. on the transfer paper sheet. The unrecognizing device may coat the unremoved image with ink having the same color as the unremoved image, or may punch the unremoved image. Thus, it is possible to prevent the transfer paper sheet having the unremoved image from being used or thrown away in error and prevent the unremoved image from being abused in advance.

16 Claims, 14 Drawing Sheets

U.S. PATENT DOCUMENTS

| | | | |
|---|---|---|---|
| 4,740,075 | 4/1988 | Schoernig . | |
| 4,800,839 | 1/1989 | Ariyama et al. . | |
| 4,899,872 | 2/1990 | Hokao . | |
| 4,905,047 | 2/1990 | Aiyama . | |
| 4,965,640 | 10/1990 | Watarai et al. . | |
| 5,063,411 | 11/1991 | Haneda et al. . | |
| 5,126,798 | 6/1992 | LeRoy et al. | 355/296 |
| 5,175,584 | 12/1992 | Usui | 355/296 |
| 5,215,852 | 6/1993 | Kato et al. . | |
| 5,239,350 | 8/1993 | Goodrow | 355/296 |
| 5,262,259 | 11/1993 | Chou et al. . | |
| 5,359,398 | 10/1994 | Echigo et al. . | |

FOREIGN PATENT DOCUMENTS

| | | |
|---|---|---|
| 54-27435 | 3/1979 | Japan . |
| 54-99353 | 8/1979 | Japan . |
| 55-30500 | 3/1980 | Japan . |
| 55-154198 | 12/1980 | Japan . |
| 57-114171 | 7/1982 | Japan . |
| 57-125962 | 8/1982 | Japan . |
| 57-125963 | 8/1982 | Japan . |
| 57-190675 | 11/1982 | Japan . |
| 58-105569 | 7/1983 | Japan . |
| 59-2069 | 1/1984 | Japan . |
| 59-33483 | 2/1984 | Japan . |
| 59-89372 | 5/1984 | Japan . |
| 59-93764 | 5/1984 | Japan . |
| 59-98172 | 6/1984 | Japan . |
| 60-133458 | 7/1985 | Japan . |
| 60-182465 | 9/1985 | Japan . |
| 60-193691 | 10/1985 | Japan . |
| 60-230899 | 11/1985 | Japan . |
| 61-213185 | 9/1986 | Japan . |
| 61-237684 | 10/1986 | Japan . |
| 62-14163 | 1/1987 | Japan . |
| 62-102270 | 5/1987 | Japan . |
| 62-203190 | 9/1987 | Japan . |
| 62-212187 | 9/1987 | Japan . |
| 62-199767 | 12/1987 | Japan . |
| 63-39377 | 2/1988 | Japan . |
| 63-73282 | 4/1988 | Japan . |
| 63-140577 | 9/1988 | Japan . |
| 1-101576 | 4/1989 | Japan . |
| 1-101577 | 4/1989 | Japan . |
| 1-137266 | 5/1989 | Japan . |
| 1-145680 | 6/1989 | Japan . |
| 1-297294 | 11/1989 | Japan . |
| 2-11400 | 1/1990 | Japan . |
| 2-3400 | 1/1990 | Japan . |
| 2-3876 | 1/1990 | Japan . |
| 2-19568 | 2/1990 | Japan . |
| 2-55195 | 2/1990 | Japan . |
| 2-59926 | 2/1990 | Japan . |
| 2-62277 | 3/1990 | Japan . |
| 2-111987 | 4/1990 | Japan . |
| 2-188293 | 7/1990 | Japan . |
| 2-188294 | 7/1990 | Japan . |
| 2-117547 | 9/1990 | Japan . |
| 2-227299 | 9/1990 | Japan . |
| 3-116594 | 5/1991 | Japan . |
| 3-218898 | 9/1991 | Japan . |
| 3-249661 | 11/1991 | Japan . |
| 4-22968 | 1/1992 | Japan . |
| 4-57070 | 2/1992 | Japan . |
| 4-64472 | 2/1992 | Japan . |
| 4-64473 | 2/1992 | Japan . |
| 4-67043 | 3/1992 | Japan . |
| 4-82983 | 3/1992 | Japan . |
| 4-89271 | 3/1992 | Japan . |
| 4-91298 | 3/1992 | Japan . |
| 4-126900 | 4/1992 | Japan . |
| 4-234056 | 8/1992 | Japan . |
| 4-118499 | 10/1992 | Japan . |
| 4-118500 | 10/1992 | Japan . |
| 4-281096 | 10/1992 | Japan . |
| 4-300395 | 10/1992 | Japan . |
| 4-301664 | 10/1992 | Japan . |
| 4-327299 | 11/1992 | Japan . |
| 4-333088 | 11/1992 | Japan . |
| 4-333699 | 11/1992 | Japan . |
| 4-356085 | 12/1992 | Japan . |
| 4-356086 | 12/1992 | Japan . |
| 4-356087 | 12/1992 | Japan . |
| 4-356088 | 12/1992 | Japan . |
| 4-356089 | 12/1992 | Japan . |
| 4-362935 | 12/1992 | Japan . |
| 5-2356 | 1/1993 | Japan . |
| 5-32926 | 2/1993 | Japan . |
| 5-61382 | 3/1993 | Japan . |
| 5-127571 | 5/1993 | Japan . |
| 5-148435 | 6/1993 | Japan . |
| 5-173454 | 7/1993 | Japan . |
| 5-216374 | 8/1993 | Japan . |
| 5-216375 | 8/1993 | Japan . |
| 5-216376 | 8/1993 | Japan . |
| 5-221128 | 8/1993 | Japan . |
| 5-232737 | 9/1993 | Japan . |
| 5-232738 | 9/1993 | Japan . |
| 6-13651 | 2/1994 | Japan . |
| 6-13652 | 2/1994 | Japan . |
| 6-43682 | 2/1994 | Japan . |
| 6-67576 | 3/1994 | Japan . |
| 6-206358 | 7/1994 | Japan . |
| 6-208318 | 7/1994 | Japan . |
| WO 89/03728 | 5/1989 | WIPO . |

METHOD AND APPARATUS FOR REMOVING IMAGE FORMING SUBSTANCE FROM IMAGE HOLDING MEMBER

BACKGROUND OF THE INVENTION

1. Field of the Invention

The present invention relates to a method and an apparatus for removing an image forming substance from an image holding member in which the image forming substance is stably attached onto the image holding member by an image forming apparatus such as a copying machine, a facsimile telegraph, a printer, etc., and is separated and removed from this image holding member.

2. Description of the Related Art

There are generally various kinds of known image forming substance removing methods and apparatuses for removing an image forming substance such as toner from a sheet of paper as a recorded image holding member. For example, Japanese Patent Application Laying Open (KOKAI) No. 1-101576 shows an image forming substance removing method using a solvent. In this removing method, toner is attached onto a sheet of paper and this paper sheet is dipped into a soluble solvent of toner resin. Then, a supersonic wave is vibrated in this paper sheet so that the toner dissolved into the solvent is separated from a paper face. Japanese Patent Application Laying Open (KOKAI) No. 4-300395 shows another image forming substance removing method. In this removing method, toner is dissolved in a printed portion of a sheet of used paper by attaching a solvent to this printed portion using a dipping, spraying or coating method, etc. The dissolved toner is removed from the printed portion by a method using cleaning, air suction, absorbent contact, mechanical separation or electrostatic adsorption, etc.

In contrast to this, for example, Japanese Patent Application Laying Open (KOKAI) No. 2-255195 shows an image forming substance removing method in which no solvent is used. In this removing method, thermally melted ink or toner is attached onto a printed member by an electrophotographic system or a thermal transfer system. In this printed member, a mold-releasing agent is coated and attached onto a supporting member. This printed member is then overlapped with an ink separating member and is moved between a heating roller and a pressure roller. After this printed member is cooled, the ink separating member is separated from the printed member so that the ink or toner is attached onto the ink separating member and is removed from the printed member. Japanese Patent Application Laying Open (KOKAI) No. 4-64472 shows an eraser having at least an endless sheet, a heating roller, a cooling roller, a pressing roller and a driving section for operating these members in association with each other. The endless sheet has thermally melted resin on a surface thereof. The heating and cooling rollers support and rotate this endless sheet. The pressing roller presses a sheet of erasable paper having a mold-released surface against thermally softened or melted resin. Japanese Patent Application Laying Open (KOKAI) No. 4-82983 shows an image forming substance removing apparatus having two parallel rollers, a heater, a scraper and a separator. The two parallel rollers come in press contact with each other and are rotated such that a sheet of paper passes through a press contact portion of these rollers. The heater heats at least one of these two rollers. The scraper separates the paper sheet passing through the press contact portion from the parallel rollers. The separator removes an image forming substance attached onto the parallel rollers from the parallel rollers.

No solvent is used in the above removing methods and apparatus. Each of the removing method and apparatus can be used to remove the image forming substance from a recorded image holding member in which an image is recorded onto a sheet of normal paper having exposed paper fibers on a surface thereof. In this case, for example, the image forming substance having thermally melted resin as a principal component is melted and attached onto the image holding member in a fixing process of the electrophotographic system. Therefore, the image forming substance is strongly fixed to paper fibers on a surface of the image holding member. Accordingly, when the image forming substance is removed from the image holding member, the paper fibers are removed from this surface together with the image forming substance so that the paper sheet is damaged and a paper quality is reduced. In particular, when the above ink separating member, the endless sheet or each of the rollers is heated and pressurized to efficiently remove the image forming substance from the image holding member, there is a case in which fixing force between the image forming substance and the image holding member is conversely increased in accordance with various kinds of conditions. In this case, it is difficult to remove the image forming substance from the image holding member.

Therefore, for example, inventors of this application proposed an image forming substance removing method in Japanese patent application No. 4-255916. In this removing method, at least one kind of water or aqueous solution is selected from a group of water as an unstabilizing agent, an aqueous solution including a surfactant, an aqueous solution including a water-soluble polymer, and an aqueous solution including a surfactant and a water-soluble polymer. This selected water or aqueous solution is held in a recorded image holding member. The image forming substance is heated or pressurized and is adhered to a separating member so that the image forming substance is separated from the image holding member. In this removing method, only the image forming substance can be removed from the image holding member without relatively reducing a paper quality of the image holding member.

In this general apparatus for removing the image forming substance from the image holding member, the unstabilizing agent is provided to the recorded image holding member. Thereafter, the image forming substance is separated from the image holding member through the separating member by heating or pressurizing adhesion of the image forming substance to the separating member. In this case, when the image holding member is stamped in red seal-ink, a Shachihata (a trade name in Japan) stamp, etc. and is additionally written with a sign pen, a ball-point pen, a lead pencil, a red pencil, etc., there is a case in which no image forming substance forming an image by each of the stamp and the additional writing can be removed from the image forming substance. Accordingly, the image forming substance is left on the image holding member in this case. The following problems are caused in a certain case when an image of the image forming substance cannot be removed from the image holding member by the above image forming substance removing apparatus and is left on this image holding member. For example, there is a fear of reusing the image holding member as a new image holding member although the unremoved image is left on this image holding member. When the image holding member having the unremoved image is not reused but is thrown away, there is also a fear of causing a secrecy problem. Further, there is a fear of intentionally abusing (altering and forging) the image holding member having the unremoved image such as a seal print, a signature, etc. When only an image holding member having no unremoved image is reused, it is necessary to sort and discriminate this image holding member from the image holding member having the unremoved image when the image holding member having the unremoved image is included within many image holding members processed with respect to removal of the image forming substance.

SUMMARY OF THE INVENTION

It is therefore a first object of the present invention to provide a method and an apparatus for removing an image forming substance from an image holding member in which it is possible to prevent an image holding member having an unremoved image from being used or thrown away in error in advance and prevent the unremoved image such as a seal print, a signature, etc. from being abused in advance.

A second object of the present invention is to provide an apparatus for removing an image forming substance from an image holding member in which it is not necessary to separate an image holding member completely removing the image forming substance therefrom from the image holding member having the unremoved image in addition to the above first object.

In accordance with a first construction of the present invention, the above first object can be achieved by a method for removing an image forming substance from an image holding member, comprising the steps of a removing treatment process for removing the image forming substance from the image holding member; a process for detecting whether or not there is an unremoved image unremovable from the image holding member by the removing processing before or after the removing treatment process; and a process for additionally providing a discriminating mark for discriminating an existence or nonexistence of the unremoved image to the image holding member on the basis of detected results of the existence or nonexistence of the unremoved image. In the discriminating mark providing process, for example, the discriminating mark is additionally provided to only the image holding member having the unremoved image. Further, for example, the discriminating mark is additionally provided to only an image holding member in which a remaining amount of the unremoved image left on the image holding member is greater than a predetermined reference amount.

In accordance with a second construction of the present invention, an apparatus for removing an image forming substance from an image holding member comprises image forming substance removing means for removing the image forming substance from the image holding member; detecting means for detecting whether or not there is an unremoved image unremovable from the image holding member by the removing processing of the image forming substance removing means before or after this removing processing; discriminating mark providing means for additionally providing a discriminating mark for discriminating an existence or nonexistence of the unremoved image to the image holding member; and control means for controlling an operation of the discriminating mark providing means on the basis of detected results of the existence or nonexistence of the unremoved image obtained by the detecting means. For example, the discriminating mark providing means punches the image holding member, or adds the discriminating mark such as o, x, etc. to an entire face of the image holding member. For example, the control means controls the operation of the discriminating mark providing means such that the discriminating mark is additionally provided to only the image holding member having the unremoved image, and the discriminating mark is additionally provided to only an image holding member in which a remaining amount of the unremoved image left on the image holding member is greater than a predetermined reference amount.

In accordance with a third construction of the present invention, the discriminating mark in the second construction of the removing apparatus is additionally provided in a position in which the unremoved image is left on the image holding member.

In accordance with a fourth construction of the present invention, a method for removing an image forming substance from an image holding member comprises the steps of a removing treatment process for removing the image forming substance from the image holding member; a process for detecting whether or not there is an unremoved image unremovable from the image holding member by the removing processing before or after the removing treatment process; and a process for rendering all or a portion of the unremoved image when the unremoved image unrecognizable is left on the image holding member. For example, in the rendering process for unrecognizing the unremoved image unrecognizable, the image holding member is punched in a position of the unremoved image. The unremoved image may be coated with an opaque material such as a white material, etc.

In accordance with a fifth construction of the present invention, an apparatus for removing an image forming substance from an image holding member comprises image forming substance removing means for removing the image forming substance from the image holding member; detecting means for detecting whether or not there is an unremoved image unremovable from the image holding member by the removing processing of the image forming substance removing means before or after this removing processing; unrecognizing means for rendering all or a portion of the unremoved image unrecognizable; and control means for controlling an operation of the unrecognizing means on the basis of detected results of existence or nonexistence of the unremoved image obtained by the detecting means. For example, the unrecognizing means is constructed such that the image holding member is punched in a position of the unremoved image and the unremoved image is coated with an opaque material such as a white material, etc.

In accordance with a sixth construction of the present invention, the detecting means in the fifth construction of the removing apparatus has seal print detecting means for detecting existence or nonexistence of a seal print on the image holding member; and the unrecognizing means has seal print invalidating means for blotting the seal print.

In accordance with a seventh construction of the present invention, to achieve the above second object, the image forming substance removing apparatus having the second, third, fifth or sixth construction further comprises sorting means for sorting the image holding member after the removing processing of the image forming substance; and control means for controlling an operation of the sorting means on the basis of the detected results of the existence or nonexistence of the unremoved image obtained by the detecting means. The control means controls the operation of the sorting means such that the image holding member having the unremoved image is sorted and discriminated from an image holding member completely removing the image forming substance therefrom.

In accordance with an eighth construction of the present invention, the removing treatment process in the first or fourth construction of the removing method has an unstabilizing treatment process for changing an attaching state between the image holding member and the image forming substance to an unstable state; and a separating treatment process for separating and removing the image forming substance in the unstable state from the image holding member.

In accordance with a ninth construction of the present invention, the image forming substance removing means in the second, third, fifth, sixth or seventh construction of the removing apparatus has unstabilizing agent providing means for providing an unstabilizing agent to the image holding member; the unstabilizing agent changing an attaching state between the image holding member and the image forming substance to an unstable state; and separating means for separating and removing the image forming substance from the image holding member by making a separating member come in contact with the image forming substance in the unstable state.

In each of the first to ninth constructions of the present invention, for example, the unremoved image includes an image formed by a stamp of red seal-ink, a Shachihata (a trade name in Japan) stamp, etc., handwritten characters additionally written with a sign pen, a ball-point pen, a lead pencil, a red pencil, etc.

In the first construction of the present invention, it is detected whether or not there is an unremoved image unremovable from the image holding member by the removing processing before or after the removing treatment process for removing the image forming substance from the image holding member. A discriminating mark for discriminating an existence or nonexistence of the unremoved image is additionally provided to the image holding member on the basis of detected results of the existence or nonexistence of the unremoved image. For example, the discriminating mark is added to only the image holding member having the unremoved image. The image holding member having the unremoved image is easily discriminated from an image holding member completely removing the image forming substance therefrom by the discriminating mark added onto this image holding member.

In the second construction of the present invention, the detecting means detects whether or not there is an unremoved image unremovable from the image holding member by the removing processing of the image forming substance removing means before or after this removing processing. The discriminating mark providing means additionally provides a discriminating mark for discriminating an existence or nonexistence of the unremoved image to the image holding member. The control means controls an operation of the discriminating mark providing means on the basis of detected results of the existence or nonexistence of the unremoved image obtained by the detecting means. For example, the control means controls the operation of the discriminating mark providing means such that the discriminating mark is added to only the image holding member having the unremoved image. The image holding member having the unremoved image is easily discriminated from an image holding member completely removing the image forming substance therefrom by the discriminating mark added onto this image holding member.

In the third construction of the present invention, the discriminating mark is additionally provided in a position in which the unremoved image is left on the image holding member. Accordingly, no unremoved image can be recognized.

In the fourth construction of the present invention, it is detected whether or not there is an unremoved image unremovable from the image holding member by the removing processing before or after the removing treatment process for removing the image forming substance from the image holding member. When the unremoved image is left on the image holding member, this unremoved image is set to be unrecognizable. For example, the image holding member is punched in a position of the unremoved image. Otherwise, the unremoved image is coated with an opaque material such as a white material, etc. Thus, the unremoved image can be unrecognized on the image holding member when the image holding member is reused and thrown away.

In the fifth construction of the present invention, the detecting means detects whether or not there is an unremoved image unremovable from the image holding member by the removing processing of the image forming substance removing means before or after this removing processing. The control means controls an operation of the rendering means for unrecognizing the unremoved image unrecognizable on the basis of detected results of an existence or nonexistence of the unremoved image obtained by the detecting means. For example, when the unremoved image is left on the image holding member, the operation of the unrecognizing means is controlled such that the image holding member is punched in a position of the unremoved image. Otherwise, the operation of the unrecognizing means is controlled such that the unremoved image is coated with an opaque material such as a white material, etc. Thus, the unremoved image can be rendered unrecognizable on the image holding member when the image holding member is reused and thrown away.

In the sixth construction of the present invention, the seal print detecting means detects an existence or nonexistence of a seal print on the image holding member before or after the removing processing of the image forming substance removing means for removing the image forming substance from the image holding member. The control means controls an operation of the seal print invalidating means for blotting the seal print on the basis of detected results of the existence or nonexistence of the unremoved image obtained by the detecting means. Thus, the unremoved image can be rendered unrecognizable on the image holding member when the image holding member is reused and thrown away.

In the seventh construction of the present invention, the control means controls an operation of the sorting means for sorting the separated image holding member on the basis of detected results of the existence or nonexistence of the unremoved image obtained by the detecting means. For example, the image holding member having the unremoved image can be automatically sorted and discriminated from an image holding member completely removing the image forming substance therefrom.

In the eighth construction of the present invention, an attaching state between the image holding member and the image forming substance stably attached onto this image holding member is changed to an unstable state in the unstabilizing treatment process. In the separating treatment process, the image forming substance in the unstable state is separated and removed from the image holding member. It is detected whether or not there is an unremoved image unremovable from the image holding member by the removing processing before or after the removing treatment process constructed by the unstabilizing treatment process and the separating treatment process. A discriminating mark for discriminating existence or nonexistence of the unremoved image is added to the image holding member on the basis of detected results of the existence or nonexistence of the unremoved image. The image holding member having the unremoved image is easily discriminated from an image holding member completely removing the image forming substance therefrom by the discriminating mark added onto this image holding member. When the unremoved image is left on the image holding member, this unremoved image is set to be rendered unrecognizable. Thus, the unremoved image can be rendered unrecognizable on the image holding member when the unrecognized image holding member is reused and thrown away.

In the ninth construction of the present invention, the unstabilizing agent providing means provides an unstabilizing agent to the image holding member. The unstabilizing agent changes an attaching state between the image holding member and the image forming substance to an unstable state. The separating means makes a separating member come in contact with the image forming substance in the unstable state. Thus, the image forming substance is separated and removed from a surface of the image holding member through the separating member. It is detected whether or not there is an unremoved image unremovable from the image holding member by the removing processing of the image forming substance removing means constructed by the unstabilizing agent providing means and the separating means before or after this removing processing. A discriminating mark for discriminating existence or nonexistence of the unremoved image is added to the image holding member on the basis of detected results of the existence or nonexistence of the unremoved image. The image holding member having the unremoved image is easily discriminated from an image holding member completely removing the image forming substance therefrom by the discriminating mark added onto this image holding member. When the unremoved image is left on the image holding member, this unremoved image is set to be rendered unrecognizable. Thus, the unremoved image can be rendered unrecognizable on the image holding member when the image holding member is reused and thrown away.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a method and an apparatus for removing an image forming substance from an image holding member in the present invention will next be described in detail with reference to the accompanying drawings.

In the following embodiments, the present invention is applied to an apparatus for removing an image forming substance such as thermally melted toner from an image holding member. This image forming substance removing apparatus is called a toner removing apparatus in the following description. In this toner removing apparatus, an image is formed on a sheet of transfer paper as the image holding member by an electrophotographic copying machine of a transfer type. The thermally melted toner as the image forming substance is removed from the transfer paper sheet by the toner removing apparatus.

Embodiment 1

Figure 1:
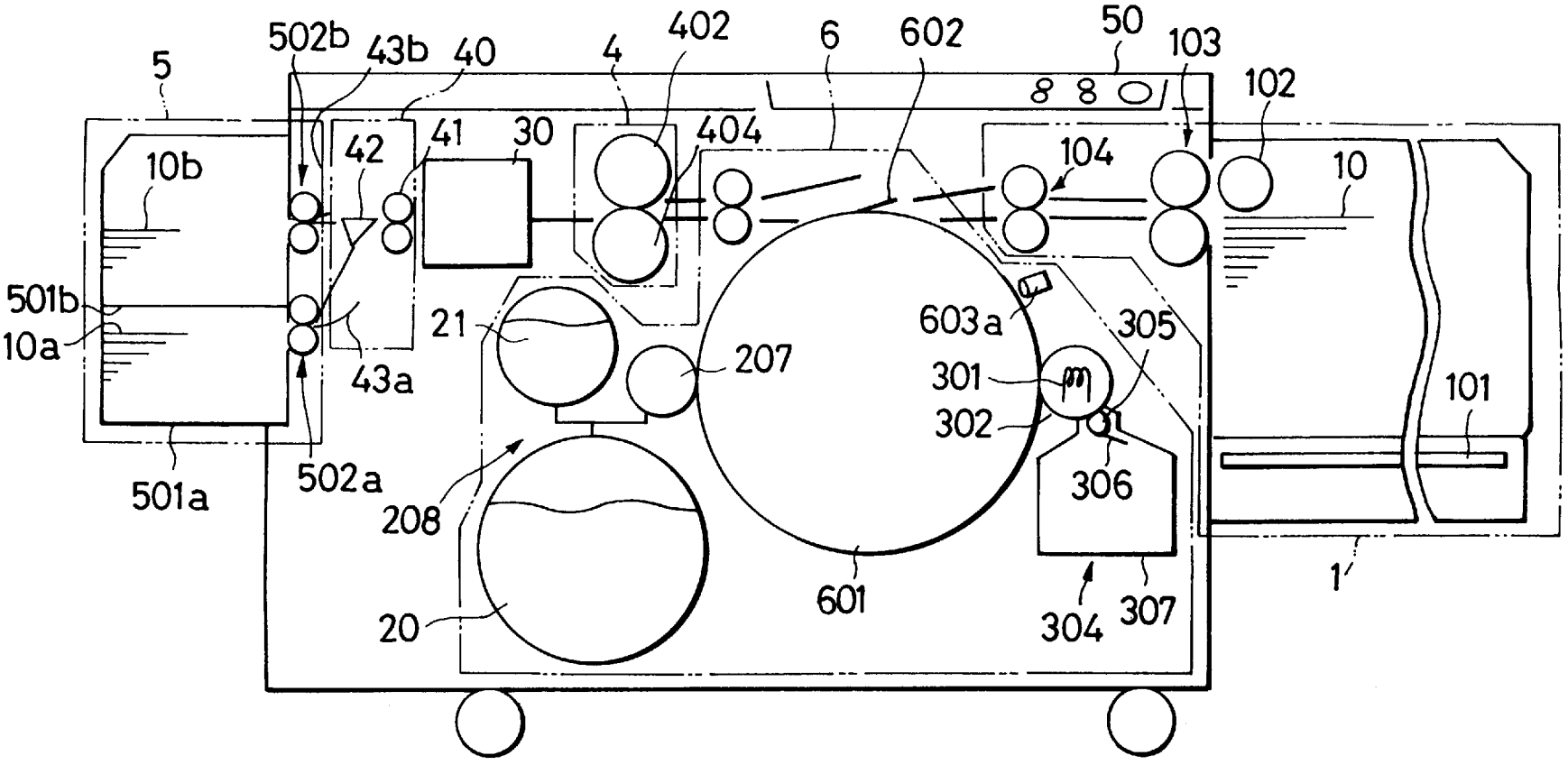
FIG. 1 is a front view showing the schematic construction of a toner removing apparatus in accordance with an Embodiment 1 of the present invention.

FIG. 1 is a front view showing the schematic construction of a toner removing apparatus in accordance with an Embodiment 1 of the present invention.

An entire construction of this toner removing apparatus will first be explained. This toner removing apparatus has a paper feed unit 1, a liquid supplying unit/toner separating unit 6, a drying unit 4, a discriminating mark providing unit 30 as a discriminating mark providing means, a sorting unit 40 and a paper receiving unit 5. Each of sheets 10 of transfer paper having a toner image is stored in the paper feed unit 1 in a stacking state and is separated and fed one by one by using the paper feed unit 1. The liquid supplying unit/toner separating unit 6 supplies a liquid to one transfer paper sheet 10 fed from the paper feed unit 1. The liquid supplying unit/toner separating unit 6 then separates and removes toner from the transfer paper sheet 10 having the supplied liquid. The drying unit 4 dries the transfer paper sheet 10 from which the toner is removed. The discriminating mark providing unit 30 provides a discriminating mark to the transfer paper sheet 10 conveyed from the drying unit 4 in accordance with necessity. The sorting unit 40 sorts the transfer paper sheet 10 from the discriminating mark providing unit 30. The paper receiving unit 5 receives the transfer paper sheet 10 sorted by the sorting unit 40.

Each of the above units 1, 4, 5, 6, 30 and 40 shown in FIG. 1 will next be explained in detail.

The above paper feed unit 1 feeds transfer paper sheets 10 stacked on a bottom plate 101 from an uppermost paper sheet by using a paper feed roller 102. Overlapped paper sheets are separated from each other by a separating roller pair 103. Thus, only one transfer paper sheet 10 is fed by a resist roller pair 104 for making a timing adjustment and making a screw correction. Concrete construction and operation of this paper feed unit 1 are similar to those of a paper feed mechanism in an electrophotographic copying machine. Accordingly, a detailed explanation of the paper feed unit is omitted in the following description.

The liquid supplying unit/toner separating unit 6 as an unstabilizing agent providing means and a separating means has a paper holding drum 601 for clamping a front end of the transfer paper sheet by a clamping claw 602 and rotating the transfer paper sheet while the front end of the transfer paper sheet is held on a circumferential face of this paper holding drum 601. The paper holding drum 601 comes in contact with a coating roller 207 and a separating roller 302 as a separating member. For example, the coating roller 207 is constructed by a sponge roller, etc. The coating roller 270 is arranged to supply a liquid to the transfer paper sheet on the paper holding drum 601.

Each of a processing liquid 20 and a permeation accelerating liquid 21 is supplied to the coating roller 207 by a liquid supplying device 208. The processing liquid 20 is an unstabilizing agent for setting an attaching state of toner stably attached onto a transfer paper sheet surface to an unstable state. The permeation accelerating liquid 21 is a permeability accelerating agent for accelerating permeation of the processing liquid 20 into the transfer paper sheet 10. The coating roller 207 is constructed such that the coating roller 207 can be separated from the paper holding drum 601 and can come in contact with the paper holding drum 601. The toner can be partially removed from the transfer paper sheet by separating and approaching operations of this coating roller 207. The toner removing apparatus can be constructed such that each of the processing liquid 20 and the permeation accelerating liquid 21 is provided to the transfer paper sheet 10 on the paper holding drum 601 by a separate coating roller.

The above processing liquid 20 can be constructed by using at least one kind of water or aqueous solution selected from a group of water including distilled water, an aqueous solution including a water-soluble polymer, an aqueous solution including a surfactant, and an aqueous solution including a water-soluble polymer and a surfactant. A predetermined organic solvent can be included in this selected water or aqueous solution. The processing liquid 20 can be constructed by using only the organic solvent. The permeation accelerating liquid 21 can be constructed by using an aqueous solution including a surfactant, an aqueous solution including a water-soluble polymer or a surfactant, etc.

For example, the water-soluble polymer is divided into natural polymer, semi-synthetic polymer, synthetic polymer, etc. The natural polymer is constructed by starch, mannan, seaweeds, plant mucilage, microbiological mucilage and protein. The starch is constructed by sweet potato starch, potato starch, tapioca starch, wheat starch, corn starch, etc. The mannan is constructed by devil's tongue, etc. The seaweeds are constructed by funorin, agar, sodium alginate, etc. The plant mucilage is constructed by hibiscus, tragacanth, gum arabic, etc. The microbiological mucilage is constructed by dextran, levan, etc. The protein is constructed by glue, gelatin, casein, collagen, etc. The semi-synthetic polymer is constructed by cellulose and starch. The cellulose is constructed by viscose, methyl cellulose, ethyl cellulose, hydroxy ethyl cellulose, carboxy methyl cellulose, etc. The starch is constructed by soluble starch, carboxy methyl starch, dialdehyde starch, etc. However, no water-soluble polymer is limited to these materials in the present invention.

For example, the above surfactant is normally constructed by an anionic surfactant such as carboxylate, sulfonate, sulfate, phosphate, phosphonate, etc. The above surfactant is also constructed by a cationic surfactant such as amine salt, quaternary ammonium salt, benzal conium salt, benzethonium chloride, pyridinium salt, imidazolinium salt, sulfonium salt, polyethylene-polyamine, etc. The above surfactant is also constructed by an amphoteric surfactant such as amino acid, carboxybetaine, sulfobetaine, amino sulfate, amino carboxylate, imidazoline derivative, etc. The above surfactant is also constructed by a nonionic surfactant of ether type, ether-ester type, ester type, nitrogen-including type, polyhydric alcohol, amino alcohol, polyethylene glycol, etc. The above surfactant is also constructed by a fluorosurfactant, etc. However, the present invention is not limited to these surfactants.

The above organic solvent included in water or an aqueous solution is constructed by turpentine, dipentene, butyl acetate, carbon tetrachloride, Cellosolve acetate, xylene, toluene, ethyl acetate, diacetone alcohol, methyl Cellosolve acetate, benzene, methyl ethyl ketone, methyl acetate, methylene chloride, ethylene dichloride, cyclohexane, Cellosolve, dioxane, acetone, methyl Cellosolve, cyclohexanol, butanol, etc. However, the present invention is not limited to these organic solvents.

When only the organic solvent is independently used as the processing liquid, the organic solvent is constructed by a hydrocarbon solvent such as hexane, heptane, octane, nonane, spirit, naphtha Nos. 1 to 6 (trade name of SHELL OIL corporation), isopar E, L, K, V (trade name of EXON corporation), ip-solvent (trade name of IDEMITSU OIL Co., Ltd.), shell-sol 70, 71, solbesso 100, 150 (trade name of SHELL OIL corporation), ascom OMS, 460 (trade name of SPIRITS Co., Ltd.), begasol 1030, 2130, 3040 (trade name of MOBIL OIL Co., Ltd.), etc. Further, this organic solvent is constructed by a fluorosolvent such as florinate FC40, 43, 70, 77 (trade name of SUMITOMO 3M Co., Ltd.), afludo E10, 16, 18, etc., a silicon solvent such as sin-etsu silicon KF96 (trade name), tohre silicon SH200, 344 (trade name), toshiba silicon TSF431 (trade name), etc. However, the present invention is not limited to these solvents.

A surface of the separating roller 302 is constructed by using a material having an adhesive force stronger than that between the transfer paper sheet 10 and at least softened toner. Concretely, this surface of the separating roller 302 can be constructed by using toner component resin equal to or similar to the above toner, component resin of an adhesive, etc. This surface of the separating roller 302 can be also constructed by using a metallic material including aluminum, copper, nickel, ion, etc. However, no material of the surface of the separating roller 302 is limited to these materials. Each of the above resins may be constructed by water-soluble resin or water-insoluble resin.

The toner component resin is constructed by polystyrene resin, acrylic resin, methacrylic resin, styrene-butylacrylic copolymer, styrene-butadiene copolymer, polyester resin, epoxy resin, etc. However, no toner component resin is limited to these resins.

For example, an adhesive for component resin is constructed by each of protein adhesives of glue, gelatin, albumin, casein, etc. This adhesive is also constructed by each of carbohydrate adhesives of starch, cellulose, composite polysaccharide such as gum arabic, tragacanth rubber, etc. This adhesive is also constructed by each of thermoplastic adhesives of polymer and copolymer of vinyl acetate, acrylic, ethylene copolymer, polyamide, polyester, polyurethane, etc. This adhesive is also constructed by each of rubber adhesives of polychloroprene, nitrile rubber, regenerated rubber, SBR, natural rubber, etc. This adhesive is also constructed by each of pressure sensitive adhesives of rubber, acrylic, etc. Further, this adhesive is constructed by polyethylene terephthalate (PET) having dispersed titanium oxide. However, this adhesive for component resin is not limited to these adhesives.

When each of the above resins is used, it is desirable to provide a multiple layer structure having at least two layers composed of a supporting member and a surface layer in view of prevention of extension caused by tension and heat, durability, etc. Namely, when the separating member is formed in the shape of a roller as shown in FIG. 1, the separating member is desirably constructed by forming a surface layer made of each of the resins, etc., on a basic roller as the supporting member.

For example, the supporting member for supporting each of the above resins, etc. can be constructed by using a rubber roller, a sheet, a cellophane tape, a Kraft paper adhesive tape, a polyvinyl chloride tape, an acetone tape, a filament reinforcing tape, etc. However, the supporting member is not limited to these materials.

A heating lamp 301 is arranged as a means for softening toner within the separating roller 302. This heating lamp 301 heats toner coming in close contact with front and rear faces of the transfer paper sheet 10 and fixed to this transfer paper sheet 10 so that this toner is softened. Thus, this toner is easily separated from fibers of the transfer paper sheet 10. The heating lamp 301 desirably heats the toner to such an extent that no toner on the transfer paper sheet 10 is melted in a press contact portion between the separating roller 302 and the drum 601. When the toner is melted, it is difficult to transfer the toner on the transfer paper sheet 10 onto a side of the separating roller 302 without separating this toner on sides of the paper sheet and the separating roller 302. When the transfer paper sheet 10 is excessively heated, the transfer paper sheet 10 is excessively dried while the transfer paper sheet 10 passes through the press contact portion between the separating roller 302 and the drum 601. Accordingly, a fixing force of the toner with respect to the transfer paper sheet 10 is increased in comparison with a case in which the transfer paper sheet 10 is wet. Therefore, there is a fear that the transfer paper sheet 10 is adhered to the separating roller 302 through the toner and cannot be separated from this separating roller 302. Accordingly, it is desirable to heat the toner to such an extent that reattachment of the toner can be prevented by leaving slight moisture in the transfer paper sheet 10 after the transfer paper sheet 10 has passed through a heating portion.

The above liquid supplying unit/toner separating unit 6 has a cleaner 304 for cleaning a surface of the separating roller 302, an unillustrated driving section, etc. This cleaner 304 has a cleaning roller 305 for removing toner from the surface of the separating roller 302, a scraper blade 306 and a toner receiver or a toner container 307. The scraper blade 306 scrapes off toner on the cleaning roller 305. The toner container 307 stores the toner scraped by the scraper blade 306. The cleaning roller 305 may be constructed such that the surface of the separating roller 302 is flattened by removing excessive toner from this surface. A blade, a scraper, etc. may be used instead of this cleaning roller.

A belt having surface characteristics similar to those of the separating roller 302 may be used instead of this separating roller 302. Further, a cleaning blade, a scraper, etc. coming in direct contact with the surface of the separating roller 302 may be used instead of the cleaning roller 305 of the cleaner 304.

A charge coupled device (CCD) sensor 603*a* is arranged on a downstream side of the separating roller 302 in a rotating direction of the drum 601. The CCD sensor 603*a* functions as a means for detecting an unremoved image left on the transfer paper sheet 10 held by the drum 601 after a toner separating treatment process.

The drying unit 4 dries the transfer paper sheet 10. The drying unit 4 is constructed by an upper drying roller 402 and a lower drying roller 404. For example, the upper drying roller 402 is made of aluminum and an unillustrated heating lamp is arranged within the upper drying roller 402. The lower drying roller 404 comes in press contact with the upper drying roller 402 from below. The lower drying roller 404 has a surface layer constructed by a member having a liquid supplying property. An unillustrated wringing blade for wringing and dropping a liquid from the surface layer comes in contact with the lower drying roller 404. A member formed in the shape of a belt, a hot air fan, an infrared lamp, etc. may be used instead of the pair of drying rollers 402 and 404. Otherwise, a member formed in the shape of a belt, a hot air fan, an infrared lamp, etc. may be used in addition to the pair of drying rollers 402 and 404.

The above discriminating mark providing unit 30 can be constructed by using a punching unit, a printing unit, a cutter unit, etc. The punching unit punches a hole as a discriminating mark in the transfer paper sheet 10. The printing unit prints a predetermined discriminating mark on the transfer paper sheet 10. The cutter unit cuts a portion of the transfer paper sheet 10 so that this cut portion is formed as a discriminating mark. Concrete examples of these units will be described later.

The sorting unit 40 has a conveying roller pair 41, a deflecting claw 42 and guide plates 43*a*, 43*b*, etc. for forming a conveying path. Positions of the deflecting claw 42 are switched by an unillustrated solenoid, etc. in accordance with control data from a control section described later. Thus, the transfer paper sheet 10 conveyed by the conveying roller pair 41 is separately conveyed to each of the guide plates 43*a* and 43*b*. The guide plate 43*a* forms a conveying path for a transfer paper sheet 10*a* having no unremoved image. The guide plate 43*b* forms a conveying path for a transfer paper sheet 10*b* having an unremoved image.

The above paper receiving unit 5 has two paper discharging trays 501*a* and 501*b* for receiving the transfer paper sheet 10 sorted by the sorting unit 40. The transfer paper sheet 10*a* having no unremoved image is discharged onto the paper discharging tray 501*a* by a discharging roller pair 502*a*. In contrast to this, the transfer paper sheet 10*b* having the unremoved image is discharged onto the paper discharging tray 501*b* by a discharging roller pair 502*b*.

This toner removing apparatus also has a means for detecting whether the transfer paper sheet 10 is arranged on a paper feed base or not. The toner removing apparatus also has a means for detecting an overlapping state of the transfer paper sheet 10 by the paper feed unit 1. The toner removing apparatus also has a means for detecting a remaining liquid amount of a liquid container for each of the processing liquid 20 and the permeability accelerating liquid 21 of the liquid supplying device 208. The toner removing apparatus also has a means for automatically supplying the liquid to this liquid container. The toner removing apparatus also has a means for detecting a jamming state of the transfer paper sheet 10 within this toner removing apparatus. The toner removing apparatus also has a means for controlling turning-on and turning-off operations of each of the heating lamps. The toner removing apparatus further has a means for filling the toner receiving container 307 with toner. These means are omitted in FIG. 1.

Operations and controls of the above toner removing apparatus will next be explained.

Figure 2:
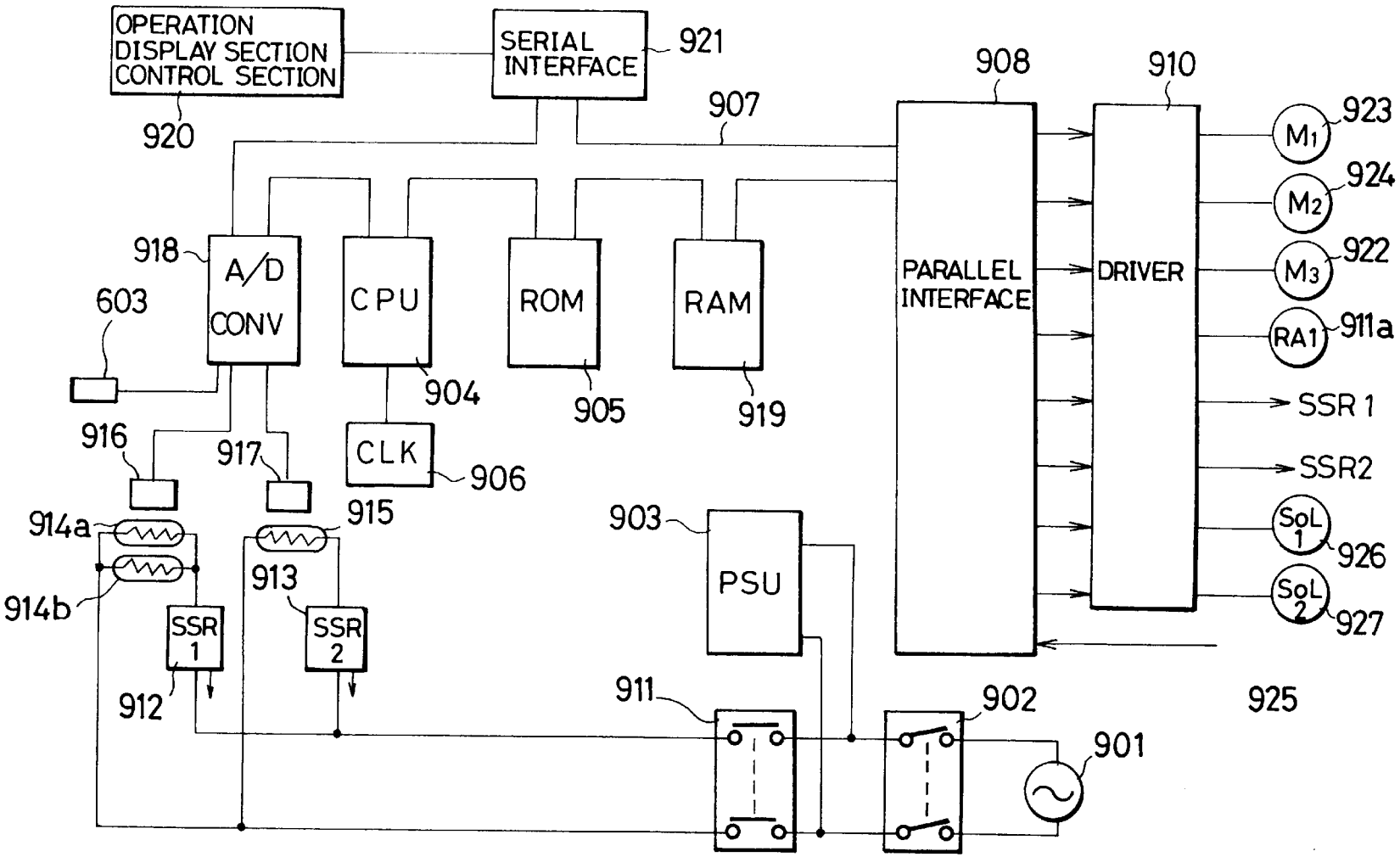
FIG. 2 is a block diagram of an electric mounting portion of the toner removing apparatus.

FIG. 2 is a block diagram of an electric mounting portion of the toner removing apparatus shown in FIG. 1. A control section as a control means of the toner removing apparatus is constructed by a central processing unit (CPU) 904, a ROM 905, a clock (CLK) signal oscillator 906, an address data bus 907, a parallel interface 908, a driver 910, an A/D converter 918, a RAM 919, a control section 920 of an operation display section 50, a serial interface 921, etc.

Alternating current power is first supplied to the toner removing apparatus from a commercial power source 901. When a main switch 902 is turned on, a direct current (DC) power voltage is supplied to each of control integrated circuits (ICs) from a direct current power source (PSU) 903. When power is supplied to the CPU 904, the CPU 904 resets a program counter, etc. and starts a control operation of the toner removing apparatus based on programmed contents written to the ROM 905. The CLK oscillator 906 supplies a reference clock (CLK) signal required for an operation of the CPU.

When data for turning a relay 911 on are transmitted through the address data bus 907 to the parallel interface 908, an electric current flows through a contact driving coil 911*a* of the relay 911 through the driver 910 connected to an output port of the parallel interface so that a contact of the relay 911 is closed.

Similar to the above case, when data for turning on each of solid state relays SSR1 (912) and SSR2 (913) are then transmitted to the driver 910, the solid state relay SSR1 (912) is turned on through the driver 910. Thus, an electric current flows through each of resistors 914*a* and 914*b* corresponding to the heating lamp 301 for heating the separating roller 302 so that the separating roller 302 begins to be heated. Further, the solid state relay SSR2 (913) is turned on through the driver 910. Thus, an electric current flows through a resistor 915 corresponding to a heating lamp 401 for heating the drying roller 402 so that this drying roller 402 begins to be heated. Temperatures of the rollers 302 and 402 are respectively detected by thermistors 916 and 917 and are inputted to the A/D converter 918 so that analog data showing these temperatures are converted to digital data. A control temperature of each of these rollers is written to the RAM 919 so that each of the temperatures of the rollers 302 and 402 is controlled in comparison with this control temperature. Data showing this control temperature can be written from the control section 920 of the operation display section 50 to the RAM 919 through the serial interface 921.

When each of the temperatures of the rollers 302 and 402 is equal to a temperature (a set value of the RAM) sufficient to separate toner or dry the transfer paper sheet, an operable display such as lighting of an LED is shown in the operation display section 50 through the control section 920. When operating command data are transmitted from the control section 920 of the operation display section, the CPU 904 operates a main drive motor 922. When a load of this main drive motor 922 is driven at a constant speed, a paper feed motor 923 is driven so that the transfer paper sheet begins to be fed. A resist motor 924 is rotated to prevent the transfer paper sheet from being skewed in accordance with timing of the paper feed motor 923 so that the transfer paper sheet 10 is fed onto the paper holding drum 601. When control data for closing the clamping claw 602 of the paper holding drum 601 are transmitted to the parallel interface 908, a solenoid 926 is operated by the driver 910 and the transfer paper sheet 10 is fixed by the clamping claw 602 so that the transfer paper sheet 10 is rotated together with the paper holding drum 601.

While the paper holding drum 601 is rotated, the operation of the toner removing apparatus is controlled as to whether or not the coating roller 207 should come in contact with the paper holding drum 601 through a coating roller solenoid 927 connected to the driver 910. Further, rotation of the coating roller 207 is controlled through an unillustrated coating roller motor. In accordance with these control operations, the transfer paper sheet 10 is coated with the processing liquid 20 and the permeation accelerating liquid 21 by the coating roller 207. Thus, the processing liquid 20 permeates at least an interface portion between the transfer paper sheet 10 and toner. Thereafter, the toner is separated and removed from the transfer paper sheet 10 by the separating roller 302 in the interface portion having the permeated processing liquid 20.

After the transfer paper sheet 10 passes through the separating roller 302, an amount of the toner on the transfer paper sheet 10 is detected by the above CCD sensor 603*a*. Data of this detection are transmitted to the CPU 904 through the A/D converter 918. When no toner is completely separated from the transfer paper sheet 10, the same separating processing is repeated some times such that the toner is completely removed from the transfer paper sheet 10. When an unremoved image is left on the transfer paper sheet 10, this unremoved image is detected by the CCD sensor 603*a*. Data of this detection are transmitted to the CPU 904 through the A/D converter 918. These detecting data are written to the RAM 919 and are used for control operations of the discriminating mark providing unit 30, the sorting unit 40, etc.

When the toner is removed from the transfer paper sheet, control data for opening the clamping claw 602 are transmitted to the parallel interface 908 and the operation of the solenoid 926 is stopped by the driver 910. Thus, the transfer paper sheet 10 is released from the clamping claw 602 and is separated from the paper holding drum 601. The transfer paper sheet 10 is then fed to the drying unit 4 and is dried by this drying unit 4.

A discriminating mark is provided to the dried transfer paper sheet 10 by the discriminating mark providing unit 30 on the basis of detection of the CCD sensor 603*a* when the transfer paper sheet 10 has an unremoved image. In contrast to this, when the transfer paper sheet 10 has no unremoved image, the transfer paper sheet 10 is fed to the sorting unit 40 without providing any discriminating mark to the transfer paper sheet 10.

When the transfer paper sheet 10*a* having no unremoved image is conveyed, the sorting unit 40 switches positions of the deflecting claw 42 on the basis of the detection of the CCD sensor 603*a* such that the transfer paper sheet 10*a* is conveyed onto the guide plate 43*a*. In contrast to this, when the transfer paper sheet 10*b* having the unremoved image and the discriminating mark is conveyed, the sorting unit 40 switches the positions of the deflecting claw 42 such that this transfer paper sheet 10*b* is conveyed onto the guide plate 43*b*. Thus, the transfer paper sheet 10*a* can be discharged onto the paper discharging tray 501*a* of the paper receiving unit 5. In contrast to this, the transfer paper sheet 10*b* can be discharged onto the paper discharging tray 501*b*.

All loads except for the paper feed roller 102, the separating roller pair 103 and the resist roller 104 are synchronously operated by the main drive motor 922. An LCT has a paper end sensor 925 for detecting an existence or nonexistence of the transfer paper sheet. When there is no transfer paper sheet, data showing nonexistence of the transfer paper sheet are transmitted to the CPU 904 through the parallel interface 908. When the CPU 904 detects the nonexistence of the transfer paper sheet, the CPU 904 stops the operation of the toner removing apparatus and this operating stoppage is displayed by lighting of an LED, etc. in the operation display section 50 through the control section 920.

In accordance with the above toner removing apparatus, a liquid is supplied to the transfer paper sheet attaching toner thereto. This toner is separated from the transfer paper sheet in a state in which the liquid permeates an interface portion between the transfer paper sheet and the toner. Accordingly, the toner can be removed from the transfer paper sheet without damaging paper fibers.

A concrete constructional example of the above discriminating mark providing unit 30 will next be explained.

Figure 3A:
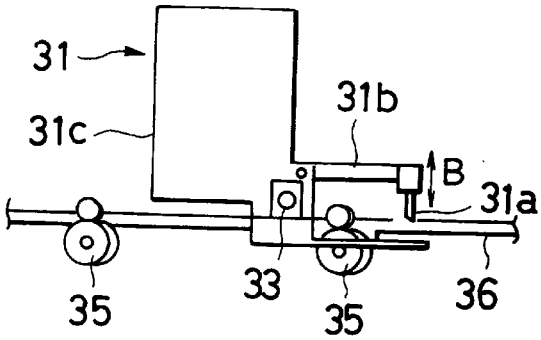
FIG. 3*a* is a front view of a punching unit used in the toner removing apparatus.
Figure 3B:
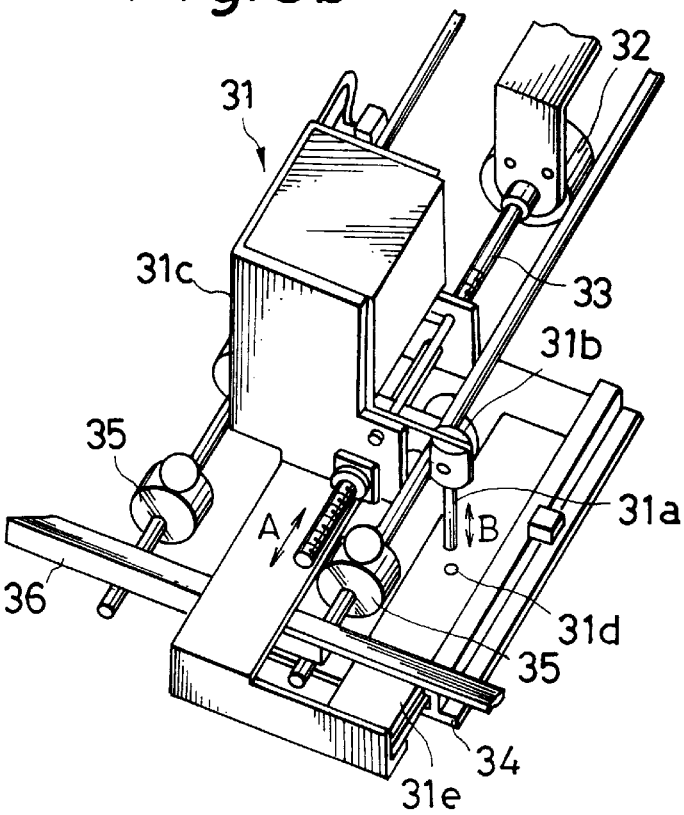
FIG. 3*b* is a perspective view of the punching unit.

FIGS. 3*a* and 3*b* are respectively front and perspective views of a punching unit as one constructional example of the discriminating mark providing unit 30. This punching unit has a movable punching body 31, a drive motor 32, a feed screw 33, a guide rail 34, a conveying roller of the transfer paper sheet 10, a conveying guide member 36, an unillustrated driving portion of the conveying roller 35, etc. An operation of the drive motor 32 is controlled by the above control section. The feed screw 33 is rotated by this drive motor 32. The guide rail 34 guides the movable punching body 31 in the direction of an arrow A in FIG. 3*b*.

The movable punching body 31 is constructed by a cylindrical punching member 31*a*, an arm portion 31*b*, a driving portion 31*c*, a punching base 31*e*, etc. An end tip portion of the cylindrical punching member 31*a* is processed and formed in a sharp shape. The punching member 31*a* is fixed to the arm portion 31*b*. An operation of the driving portion 31*c* is controlled by the above control section such that the driving portion 31*c* moves the punching member 31*a* through the arm portion 31*b* in a vertical direction equal to the direction of an arrow B in FIGS. 3*a* to 3*c*. A hole 31*d* is formed in the punching base 31*e* in a position in which the lowered punching member 31*a* is engaged with the punching base 31*e*. A through hole is formed in a side wall portion of the movable punching body 31 through which the feed screw 33 extends. An internal thread as a female screw is formed on an inner circumferential face of this through hole such that the feed screw 33 as a male screw is screwed into this female screw. The feed screw 33 is inserted into the through hole forming the female screw of the movable punching body 31 while the feed screw 33 is screwed into this through hole. Thus, the movable punching body 31 can be reciprocated in the direction of the arrow A in accordance with rotation of the feed screw 33.

A CCD sensor 603*b* may be arranged on an upstream side of the punching unit in a conveying direction of the transfer paper sheet. The CCD sensor 603*b* detects an unremoved image left on the transfer paper sheet 10, an existing punched hole, etc. This CCD sensor 603*b* is not shown in FIGS. 1 and 3.

When the transfer paper sheet 10 conveyed from the drying unit 4 is conveyed onto the punching base of the movable punching body 31 from a left-hand direction in FIG. 3*a* and the unremoved image on the transfer paper sheet 10 is detected by the CCD sensor 603*a* or 603*b*, an operation of the conveying roller 35 is controlled in the punching unit such that the transfer paper sheet is stopped in a predetermined position calculated from punching position data in advance. A punching position in a direction (equal to the direction of the arrow A) perpendicular to the conveying direction of the transfer paper sheet is controlled by rotating the feed screw 33 by the drive motor 35 and moving the movable punching body 31. After this control of the punching position is terminated, the driving portion 31*c* is operated so that the punching member 31*a* is lowered through the arm portion 31*b* to punch the transfer paper sheet 10. In this case, the number of punched holes may be set to one or more.

Figure 3C:
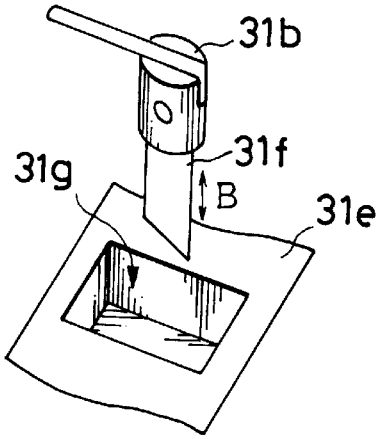
FIG. 3*c* is a partial perspective view of a cutter unit used in the toner removing apparatus.

FIG. 3*c* is a partial perspective view of a cutter unit as another constructional example of the discriminating mark providing unit 30. In this cutter unit, a cutter edge 31*f* instead of the punching member 31*a* is fixed to the arm portion 31*b* in the punching unit. Further, an opening of a collecting container 31*g* instead of the hole 31*d* for punching is formed in the base 31*e* below the arm portion 31*b* in the punching unit. The collecting container 31*g* collects pieces of the transfer paper sheet cut by the cutter edge 31*f* and dropping downward. The other mechanical constructions of this cutter unit are similar to those of the punching unit.

In this cutter unit, the transfer paper sheet 10 fed from the drying unit 4 is conveyed by the conveying roller 35 onto the base 31*e* of the movable body 31 from the left-hand direction in FIG. 3*a*. When an unremoved image is detected on the transfer paper sheet 10 by the CCD sensor 603*a* or 603*b*, the driving portion 31*c* is operated in predetermined timing so that the cutter edge 31*f* is lowered through the arm portion 31*b*. Further, the feed screw 33 is rotated by the drive motor 35 and a corner portion of the transfer paper sheet 10 is cut while the movable body 31 is moved.

In this case, it is not necessary to cut the corner portion of the transfer paper sheet 10. For example, the transfer paper sheet 10 may be cut by locating the movable body 31 in a central position of the transfer paper sheet 10 in a width direction thereof and lowering the cutter edge 31*f* such that the transfer paper sheet 10 is divided into two equal sheet parts. Further, the transfer paper sheet 10 may be divided into sheet parts in a ratio except for an equal ratio. Further, the transfer paper sheet may be similarly divided by using a cutter for cutting roll-shaped recording paper used in a facsimile telegraph, etc. in the shape of a sheet.

Figure 4:
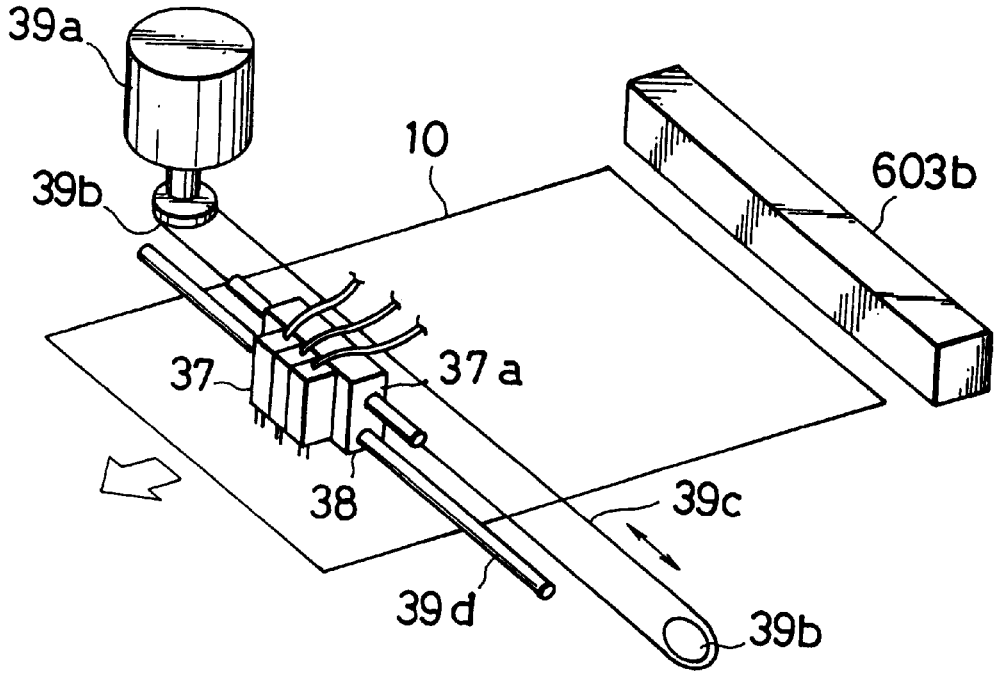
FIG. 4 is a perspective view of a printing unit used in the toner removing apparatus.

FIG. 4 is a perspective view of a printing unit as another constructional example of the discriminating mark providing unit 30. This printing unit is of an ink jet type and has a nozzle head 37, a guide bar 38, a driving portion 39 of the nozzle head 37, etc. The nozzle head 37 has two jet nozzles and is fixed to a holder 37*a*. The guide bar 38 extends through the holder 37*a* and guides a movement of the nozzle head 37. The driving portion 39 is constructed by a drive motor 39*a*, a driving pulley 39*b*, a driven pulley 39*c*, a driving wire 39*c*, etc. The driving pulley 39*b* is fixed to a rotating shaft of the drive motor 39*a*. The driving wire 39*c* is fixed to the holder 37*a* of the nozzle head and is tensioned between the pulleys 39*b* and 39*c*. The nozzle head 37 is moved through the driving wire 39*c* in a direction perpendicular to the conveying direction of the transfer paper sheet by rotating the drive motor 39*a*. The drive motor 39*a* and each of the jet nozzles of the nozzle head 37 are connected to the driver 910 of the control section.

As shown in FIG. 4, the CCD sensor 603*b* may be arranged on an upstream side of the printing unit in the conveying direction of the transfer paper sheet. The CCD sensor 603*b* detects an unremoved image on the transfer paper sheet 10, an existing discriminating mark, etc.

In the above printing unit, the transfer paper sheet 10 fed from the drying unit 4 is conveyed in an arrow direction. The nozzle head 37 is moved in a direction perpendicular to the conveying direction of the transfer paper sheet by control of the drive motor 39*a*. For example, a discriminating mark such as marks x, o, etc. is additionally provided onto an entire face of the transfer paper sheet 10 by controlling turning-on and turning-off operations of each of the jet nozzles of the nozzle head 37 in predetermined timings such that no transfer paper sheet 10 can be used. At a time of this printing control, it is not necessary to stop conveyance of the transfer paper sheet 10. However, an operation of the printing unit may be controlled such that the conveyance of the transfer paper sheet 10 is stopped in timings of the movement of the nozzle head 37 and printing of the jet nozzles.

The operation of the printing unit may be controlled such that a position of the unremoved image on the transfer paper sheet 10 is recognized and characters are printed in this position. In this case, the movement of the nozzle head 37 and turning-on and turning-off timings of the jet nozzles, etc. are controlled by the drive motor 39*a* on the basis of position data of the unremoved image detected by the CCD sensor 603*a* or 603*b*. Thus, a discriminating mark is printed on the unremoved image. At this time, for example, the same color ink as the transfer paper sheet 10 such as white ink may be used.

Figure 5:
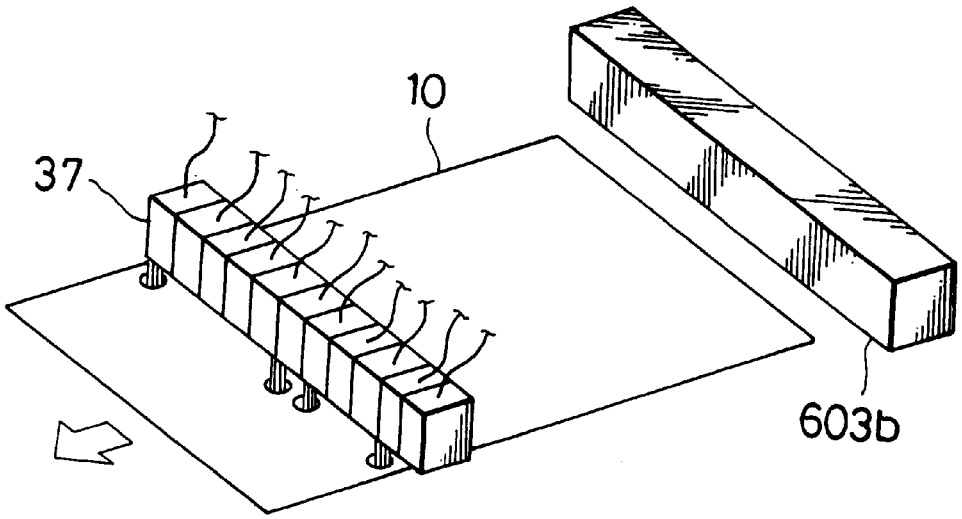
FIG. 5 is a perspective view showing a modified example of the printing unit.

In the constructional example of the printing unit shown in FIG. 4, the jet nozzles are moved in the direction perpendicular to the conveying direction of the transfer paper sheet. However, as shown in FIG. 5, a nozzle head 37 having jet nozzles arranged along an entire width of the transfer paper sheet 10 may be arranged on the transfer paper sheet 10.

In the above embodiment 1, the CCD sensor 603*a* detects an unremoved image left on the transfer paper sheet 10 after toner is separated from the transfer paper sheet 10. The unremoved image is formed by a stamp, additional writing, etc. A discriminating mark is added by the discriminating mark providing unit 30 to the transfer paper sheet 10 detected as a transfer paper sheet having the unremoved image. Therefore, the transfer paper sheet 10*b* having the unremoved image can be easily discriminated by this discriminating mark from the transfer paper sheet 10*a* from which the unremoved image is completely removed. Accordingly, it is possible to prevent the transfer paper sheet 10*b* having the unremoved image from being reused in error by discriminating the transfer paper sheets from each other. Further, it is possible to prevent the transfer paper sheet 10*b* having the unremoved image from being thrown away in error. Accordingly, a leakage of secret information can be prevented in advance. Further, it is possible to prevent the transfer paper sheet 10*b* having the unremoved image such as a stamp, a signature, etc. from being abused, altered and forged in advance.

Further, in the above embodiment 1, the transfer paper sheet 10 is automatically sorted by the sorting unit 40. The transfer paper sheet 10*b* having the unremoved image is discharged onto the paper discharging tray 501*b* of the paper receiving unit 5. In contrast to this, the transfer paper sheet 10*a* completely removing an image therefrom is discharged onto the paper discharging tray 501*a*. Accordingly, it is not necessary to manually perform a sorting operation for subsequent processings about necessariness or unnecessariness of reuse, cutting of the transfer paper sheet for holding secret information, etc.

In the above embodiment 1, the operation of the toner removing apparatus can be controlled such that a hole as a discriminating mark is formed or characters are printed on the unremoved image by the discriminating mark providing unit 30 so as not to recognize the unremoved image on the transfer paper sheet 10 later. For example, in the punching unit shown in FIGS. 3*a* to 3*c*, the movement of the movable punching body 31, operations of the conveying roller 35 and the punching member 31*b*, etc. are controlled by the drive motor 32 on the basis of position data of the unremoved image detected by the CCD sensor 603*a* or 603*b* so that the transfer paper sheet is punched on the unremoved image. If the discriminating mark is formed on the unremoved image, a leakage of secret information can be prevented in advance and it is possible to further prevent the transfer paper sheet 10*b* having the unremoved image such as a stamp, a signature, etc. from being abused, altered and forged in advance when the transfer paper sheet 10 is thrown away in error, etc.

Figure 6:
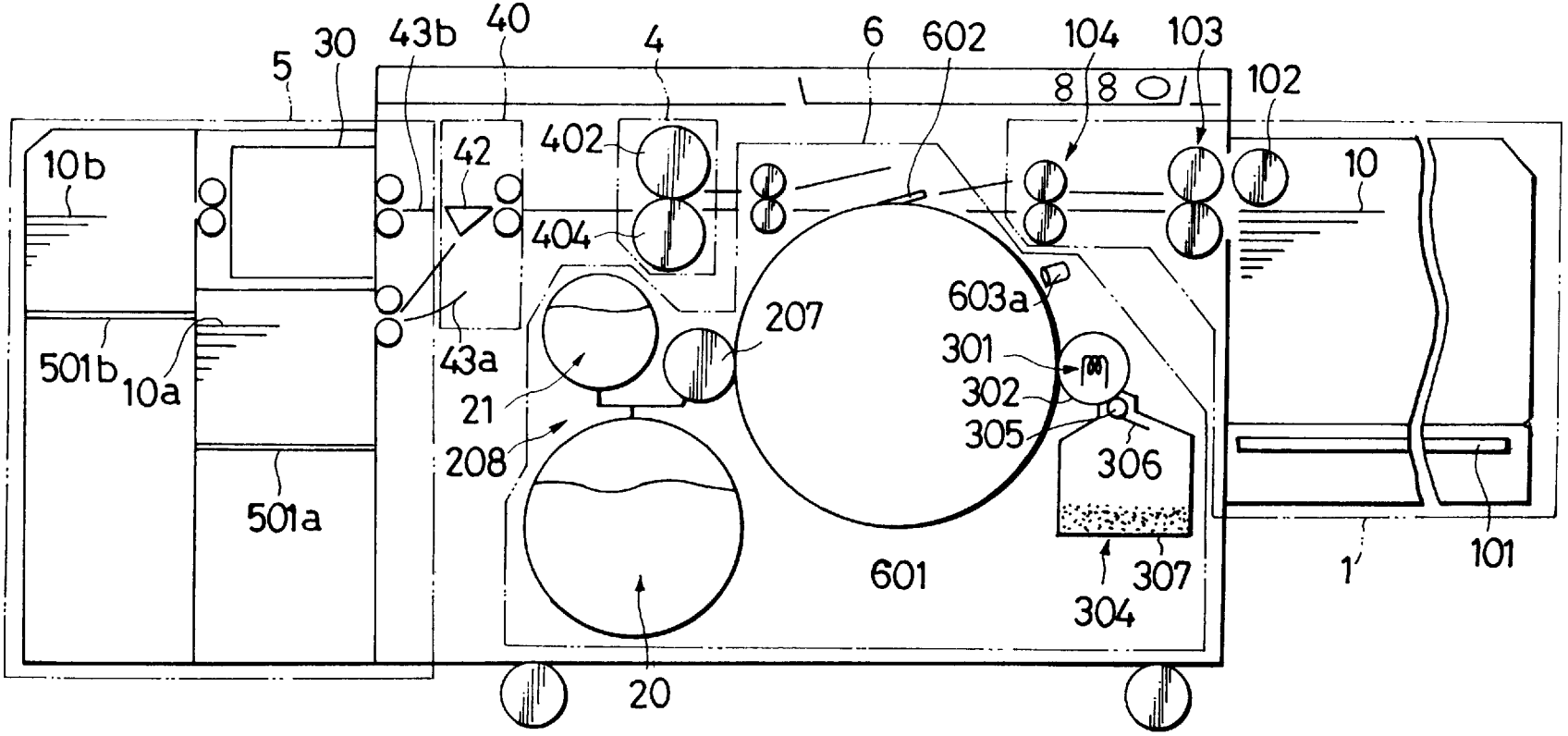
FIG. 6 is a front view showing the schematic construction of a modified example of the toner removing apparatus shown in FIG. 1.

In the above embodiment 1, the sorting unit 40 for sorting the transfer paper sheet 10 is arranged between the discriminating mark providing unit 30 and the paper receiving unit 5. However, as shown in FIG. 6, the sorting unit 40 may be arranged just after the drying unit 4. The discriminating mark providing unit 30 may be arranged just before the paper discharging tray 501*b* for discharging the transfer paper sheet 10*b* having an unremoved image within the paper receiving unit 5. In this case, after the above separation of toner, the unremoved image left on the transfer paper sheet 10 and formed by a stamp, additional writing, etc. is detected by the above CCD sensor 603*a* or 603*b*. The transfer paper sheet 10 having this detected unremoved image is sorted by the sorting unit 40. Thereafter, a discriminating mark is added to the transfer paper sheet by the discriminating mark providing unit 30 and is discharged onto the paper discharging tray 501*b* of the paper receiving unit 5. In contrast to this, the transfer paper sheet 10*a* completely removing an image therefrom is sorted by the sorting unit 40. Thereafter, the transfer paper sheet 10*a* is discharged onto the paper discharging tray 501*a* without passing through the discriminating mark providing unit 30.

A toner image sample is tested by using the toner removing apparatus shown in each of FIGS. 1 and 6 and having the punching unit of FIGS. 3*a* to 3*c* as the above discriminating mark providing unit 30. This toner image sample is stamped by a stamp of red seal-ink, a Shachihata (a trade name in Japan) stamp, etc., or is additionally written with a sign pen, a ball-point pen, a lead pencil, a red pencil, etc. In this operating test of the toner removing apparatus, a paper sheet of the toner image sample is mixed with 50 transfer paper sheets each having only a toner image. In this operating test, a discriminating mark is provided to the paper sheet of the toner image sample stamped or additionally written by punching this paper sheet. Thereafter, the paper sheet of the toner image sample can be sorted and discharged onto the paper discharging tray 501*b*.

Embodiment 2

Another embodiment of the toner removing apparatus in the present invention will next be explained.

Figure 7:
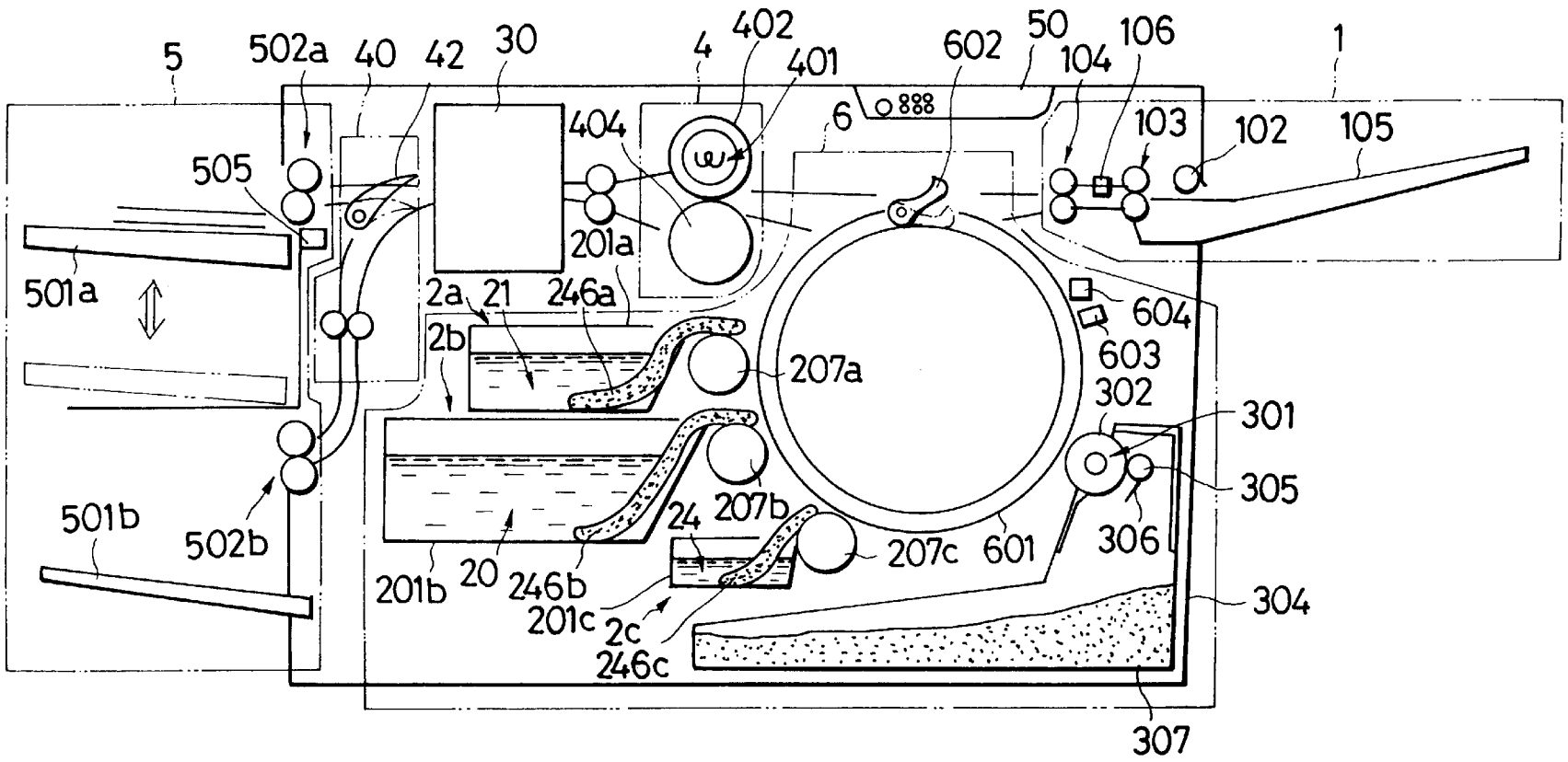
FIG. 7 is a front view showing the schematic construction of a toner removing apparatus in accordance with an Embodiment 2 of the present invention.

FIG. 7 is a front view showing the schematic construction of a toner removing apparatus in accordance with an Embodiment 2 of the present invention. In the entire construction of this toner removing apparatus, constructional members similar to those of the toner removing apparatus in the embodiment 1 shown in FIG. 1 are designated by the same reference numerals and a detailed explanation of these constructional members is omitted in the following description. Constructional portions different from those of the toner removing apparatus of FIG. 1 will be mainly explained in the following description.

A paper feed unit 1 in the toner removing apparatus in the embodiment 2 is of a manual type and has a manual base 105. The paper feed unit 1 also has a transfer paper sheet state sensor 106 for detecting a state of a transfer paper sheet 10 fed by a paper feed roller 102 and a separating roller pair 103. This transfer paper sheet state sensor 106 is constructed by a CCD sensor, etc., and reads an area ratio of an image on the transfer paper sheet 10, the number of reuses of the transfer paper sheet 10, etc.

A liquid providing portion of a liquid providing unit/toner separating unit 6 is constructed by a permeation accelerating liquid providing portion 2*a*, a processing liquid providing portion 2*b* and a liquid providing portion 2*c*. The permeation accelerating liquid providing portion 2*a* provides the above permeation accelerating liquid 21 to the transfer paper sheet 10 on a paper holding drum 601. The processing liquid providing portion 2*b* provides the above processing liquid 20 to this transfer paper sheet 10. The liquid providing portion 2*c* functions as an unrecognizing means (and a seal print invalidating means) constructed such that no unremoved image such as a seal print on the transfer paper sheet 10 can be recognized by providing a processing liquid 24 to the transfer paper sheet 10. The permeation accelerating liquid providing portion 2*a* is constructed by liquid containers 201*a*, 201*b* and 201*c*, etc. The processing liquid providing portion 2*b* is constructed by coating rollers 207*a*, 207*b* and 207*c*, etc. The liquid providing portion 2*c* is constructed by liquid supplying members 246*a*, 246*b* and 246*c* for supplying liquids from the liquid containers to the coating rollers, etc. Each of the coating rollers 207*a*, 207*b* and 207*c* is movably constructed such that each of these coating rollers comes in contact with a surface of the paper holding drum 601 or is separated from this surface. A movement of each of the coating rollers 207*a*, 207*b* and 207*c* is controlled by a control section. For example, each of the liquid supplying members 246*a*, 246*b* and 246*c* is formed by a material having a liquid supplying property such as felt and supplies a liquid within each of the liquid containers 201*a*, 201*b* and 201*c* to each of the coating rollers by a capillary phenomenon, etc. In this embodiment 2, the processing liquid 24 is constructed by a liquid for blotting a seal print of a stamp of red seal-ink, a Shachihata (a trade name in Japan) stamp, etc.

In a concrete example of the above processing liquid 24 for blotting the seal print, the processing liquid 24 can be constructed by a hydrocarbon solvent, an acetone solvent, etc. with respect to the red seal-ink and can be constructed by water, alcohol, etc. with respect to the Shachihata stamp. When the above unremoved image is additionally written with a ball-point pen, the processing liquid 24 can be constructed by alcohol, an acetone solvent, etc. In contrast to this, when the unremoved image is additionally written with a fountain pen, the processing liquid 24 can be constructed by water, etc. Further, when the unremoved image is formed by a stamp in ink of an inking pad, the processing liquid 24 can be constructed by water, alcohol, etc. The toner removing apparatus may be constructed such that no unremoved image is blotted in the above liquid providing processing by using a liquid different from the processing liquid 20 and the permeation accelerating liquid 21 as the processing liquid 24. Further, the toner removing apparatus may be constructed such that the unremoved image blotting in the above liquid providing processing is further blotted by the processing liquid 24 by using the same liquid as the processing liquid 20 or the permeation accelerating liquid 21 as the processing liquid 24.

A CCD sensor 604 is arranged in addition to the above CCD sensor 603*a* opposed to a surface of the paper holding drum 601. The CCD sensor 604 functions as a seal print detecting means for detecting an existence or nonexistence of the unremoved image as a seal print on the transfer paper sheet 10. The CCD sensor 604 is mainly sensitive to red of a seal print image formed by a stamp of red seal-ink, a Shachihata (a trade name in Japan) stamp, etc. on the transfer paper sheet 10. Otherwise, the CCD sensor 604 is mainly sensitive to a color close to this red.

A paper discharging tray 501*a* of a paper receiving unit 5 is constructed by an elevator type tray which can be raised and lowered. The paper discharging tray 501*a* has a paper discharging level sensor 505 for detecting a position level of the transfer paper sheet 10 on the paper discharging tray 501*a*.

Figure 8:
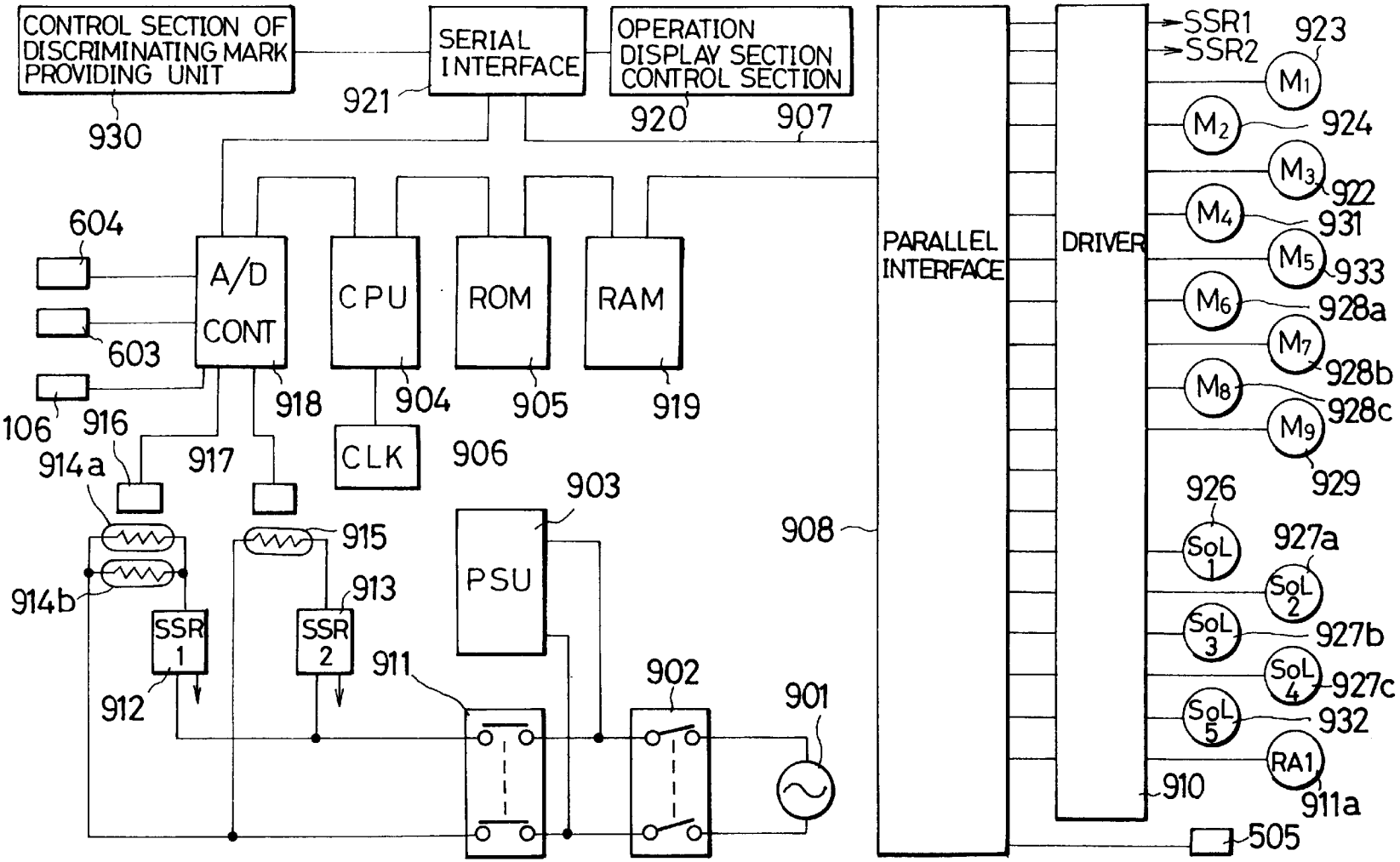
FIG. 8 is a block diagram of an electric mounting portion of the toner removing apparatus shown in FIG. 7.

Control for operating the toner removing apparatus shown in FIG. 7 will next be explained with reference to FIG. 8. An explanation of constructional portions similar to those shown in the block diagram of FIG. 2 in the embodiment 1 is omitted in the following description.

Each of coating roller solenoids 927*a*, 927*b*, 927*c* for moving the respective coating rollers 207*a*, 207*b* and 207*c* in approaching and separating directions is connected to a driver 910 of a control section. An operation of the toner removing apparatus is controlled with respect to any one of the coating rollers 207*a*, 207*b* and 207*c* coming in contact with the paper holding drum 601 in accordance with a state of the transfer paper sheet 10. Further, the coating rollers 207*a*, 207*b* and 207*c* are rotated by respective drive motors. For example, the coating roller 207*a* for the permeation accelerating liquid 21 is rotated by a coating roller motor 928*a*. Similarly, the coating rollers 207*b* and 207*c* for the processing liquids 20 and 24 are respectively rotated by coating roller motors 928*b* and 928*c*.

Similar to the above coating roller motor 928, a separating roller pressurizing motor 929 for moving a separating roller 302 in approaching and separating directions is connected to the driver 910. The separating roller pressurizing motor 929 controls approaching and separating movements of the separating roller 302 with respect to the paper holding drum 601. The separating roller pressurizing motor 929 also controls a pressurizing amount of the separating roller 302 with respect to the paper holding drum 601 in accordance with a state of the transfer paper sheet 10.

Similar to the above transfer paper sheet state sensor 106, each of the CCD sensors 603*a*, 603*b* and 604 is connected to an A/D converter 918. Similar to the control section 920 of the operation display section 50, a control section 930 of the discriminating mark providing unit 30 is connected to an address data bus 907 through a serial interface 921. The paper discharging level sensor 505 detects an existence or nonexistence of the transfer paper sheet on the paper discharging tray 501*a* of the paper receiving unit 5. This paper discharging level sensor 505 is connected to the address data bus 907 through a parallel interface 908. A paper discharging tray motor 931 for raising and lowering the paper discharging tray 501*a* is connected to the driver 910.

Figure 9:
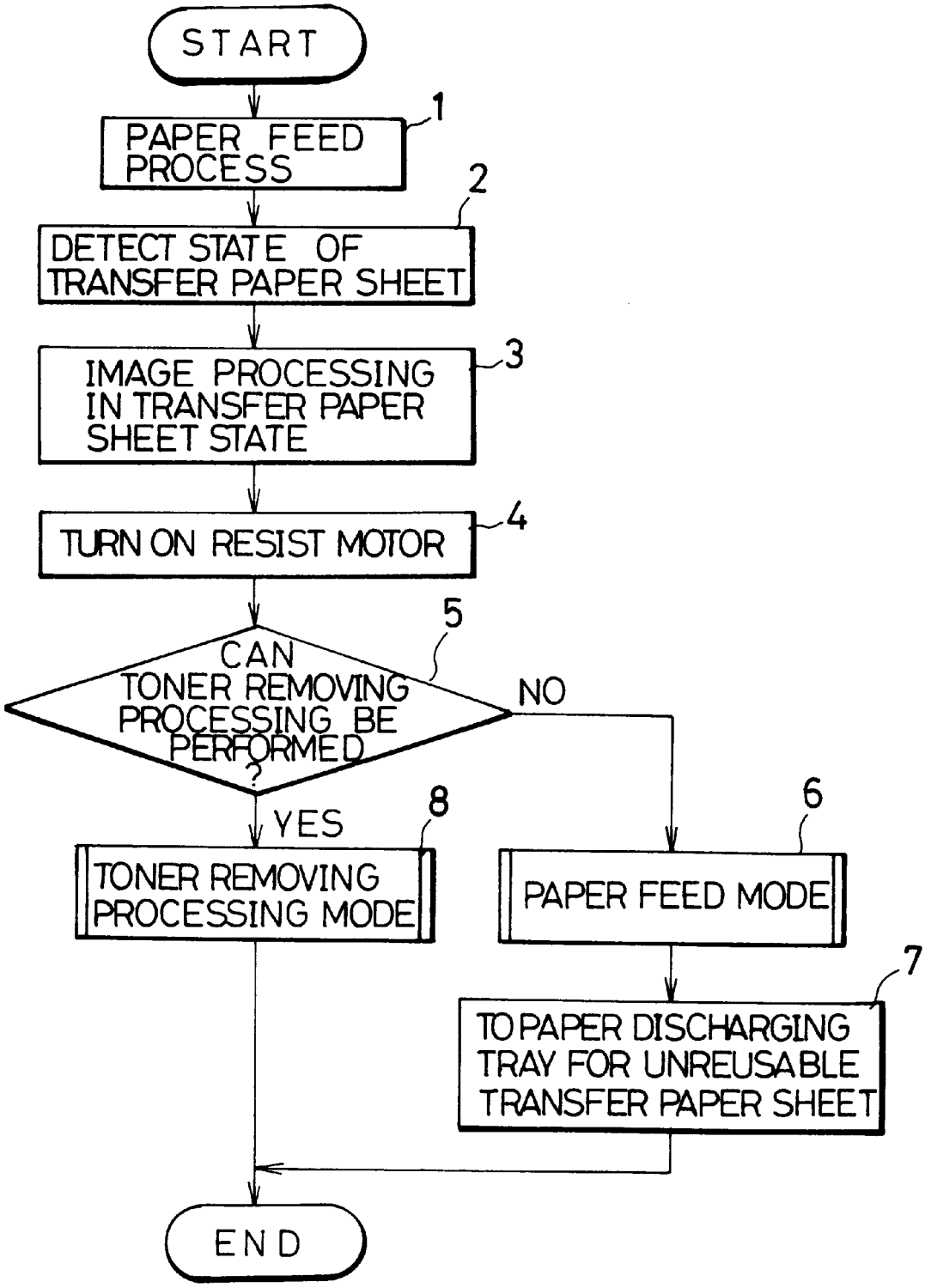
FIG. 9 is a flow chart showing control of the toner removing apparatus shown in FIG. 7.

In FIG. 9, a transfer paper sheet 10 is fed from the paper feed unit 1 in a step 1. In a step 2, the transfer paper sheet state sensor 106 reads data for judging whether the transfer paper sheet 10 is reused or not. In a step 3, these data are converted to parallel digital data by the A/D converter 918 and an image of the parallel digital data is processed to judge a state of the transfer paper sheet if necessary.

In a step 4, a resist motor 924 is rotated to prevent the transfer paper sheet from being skewed in accordance with timing of a paper feed motor 923. Next, it is judged in a step 5 whether or not toner removing processing can be performed by comparing data indicative of the above transfer paper sheet state with contents written to a ROM 905. These contents include a limit value of an image area ratio, a reuse limit value, etc. In a step 6, a paper feed mode is started when it is judged that no toner removing processing can be performed. In this paper feed mode, a deflecting claw solenoid 932 is operated in a step 7 so that the transfer paper sheet 10 is discharged onto the paper discharging tray 501*b*. In contrast to this, when it is judged that the toner removing processing can be performed, a toner removing processing mode shown in FIG. 10 and described later is executed in a step 8.

Figure 10:
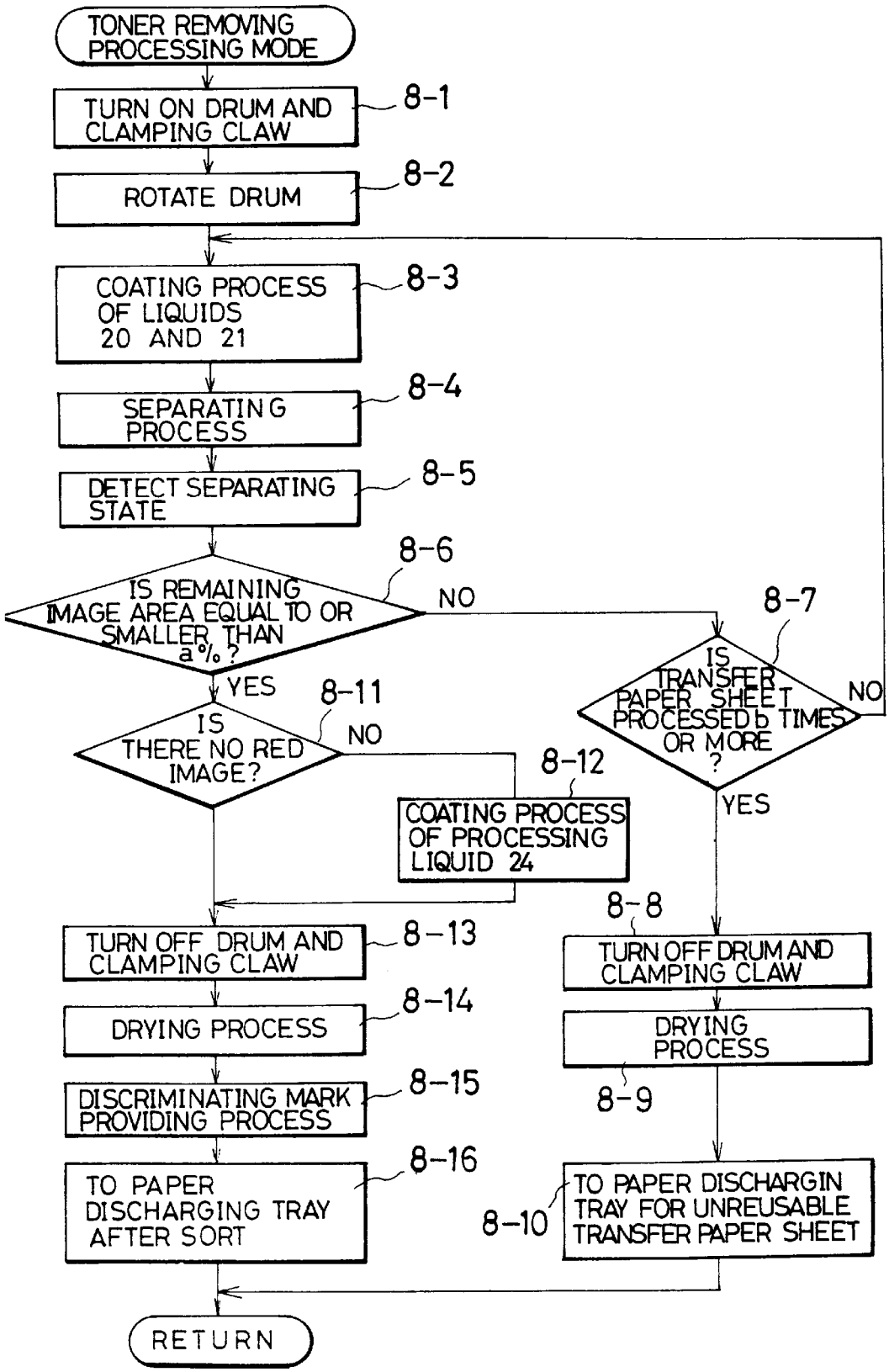
FIG. 10 is a flow chart showing a toner removing treatment process shown in FIG. 9.

In the toner removing processing mode shown in FIG. 10, the transfer paper sheet 10 is fed by the resist motor 924 to the position of a clamping claw 602 opening toward the paper holding drum 601. A solenoid 926 for opening and closing the clamping claw 602 with respect to the paper holding drum 601 is operated in a step 8-1 so that the clamping claw 602 is closed and holds the transfer paper sheet 10. In a step 8-2, a paper holding drum motor 933 is turned on so that the paper holding drum 601 is rotated.

In a step 8-3, the transfer paper sheet 10 on the paper holding drum 601 is coated by the coating rollers 207*a* and 207*b* with the permeation accelerating liquid 21 such as a surfactant and the processing liquid 20 such as distilled water. Thus, the processing liquid 20 and the permeation accelerating liquid 21 permeate an interface portion between the transfer paper sheet 10 and toner. Conditions for coating the transfer paper sheet 10 with the processing liquid 20 and the permeation accelerating liquid 21 may be set to be different from each other on the basis of state data of the transfer paper sheet 10 read by the above transfer paper sheet state sensor 106.

In a step 8-4, the transfer paper sheet 10 and the toner attached onto this transfer paper sheet are set to be easily separated from each other by heating a heater 301. Further, this toner is separated and removed from the transfer paper sheet 10 by the separating roller 302. In a step 8-5, the CCD sensor 603*a* detects an unremoved image left on the transfer paper sheet 10. Further, the CCD sensor 604 detects a seal print, etc. on the transfer paper sheet 10. For example, this seal print is formed by a red image having a circular, elliptical or square shape, etc. In a step 8-6, it is judged whether the ratio of a remaining image area of the unremoved toner image is equal to or smaller than a predetermined value of a %. In the case of NO in this judgment, it is further judged in a step 8-7 whether the above liquid providing processing and the separating processing are performed a predetermined b times or more. In the case of NO in this judgment, it is returned to the above step 8-3 so that the liquid providing processing and the separating processing are repeated. Thus, the toner can be completely removed from the transfer paper sheet 10. In contrast to this, when the judgment in the step 8-7 is YES, no toner image having a constant area can be separated from the transfer paper sheet 10 even when the liquid providing processing and the separating processing are performed a predetermined times. In this case, the solenoid 926 is turned off even when the toner separating processing is performed. Further, the clamping claw 602 is opened to release the transfer paper sheet 10 and the transfer paper sheet 10 is dried by the drying unit 4. Thereafter, the transfer paper sheet 10 is discharged onto the paper discharging tray 501*b* for an unreusable transfer paper sheet in steps 8-8 to 8-10.

When the judgment in the above step 8-6 is YES, the remaining image area is equal to or smaller than a %. In this case, it is further judged in a step 8-11 whether or not there is a seal print on the transfer paper sheet 10. When the seal print is left on the transfer paper sheet 10, the transfer paper sheet 10 is coated with an ink blotting agent as the processing liquid 24 by the coating roller 207*c* in a step 8-12. Thus, the seal print is blotted so that no seal print can be recognized. Then, the solenoid 926 is turned off to open the clamping claw 602 in a step 8-13 so that the transfer paper sheet 10 is released. In a step 8-14, the transfer paper sheet 10 is dried by the drying unit 4.

In a step 8-15, a discriminating mark corresponding to the number of reuses is provided to the transfer paper sheet 10 by the discriminating mark providing unit 30. This discriminating mark providing unit 30 can be constructed by the punching unit, the printing unit, the cutter unit, etc. shown in the above embodiment 1. When the punching unit is used, the CCD sensor 603*a* or 603*b* detects whether there is already a punched hole or not. When there is a punched hole, an operation of the punching unit is controlled such that the transfer paper sheet 10 is punched in e.g., a position adjacent to this punched hole. When the printing unit is used, the CCD sensor 603*a* or 603*b* detects whether there is already a mark such as o, x, etc. printed at a front end of the transfer paper sheet, etc. When this mark such as o, x, etc. is printed, an operation of the printing unit is controlled such that characters are printed in, e.g., a position adjacent to this mark. Further, colors of the discriminating mark may be changed in accordance with the number of reuses. For example, red, blue, yellow, green,—are respectively set to correspond to reuse numbers 1, 2, 3, 4,—. When the CCD sensor 603*a* or 603*b* detects a red discriminating mark, the operation of the printing unit is controlled such that a blue discriminating mark is formed on this red discriminating mark. This discriminating mark is used as data showing a state of the transfer paper sheet.

The transfer paper sheet 10 is next sorted by the sorting unit 40 in a step 8-16. A transfer paper sheet 10*a* having no seal print is discharged onto the paper discharging tray 501*a* for a reused transfer paper sheet. A transfer paper sheet 10*b* having the seal print coated with the processing liquid 24 is discharged onto the paper discharging tray 501*b* for an unreusable transfer paper sheet. The paper discharging level sensor 505 detects the transfer paper sheet discharged onto the paper discharging tray 501*a* and transmits data showing an existence of the transfer paper sheet through the parallel interface 908. A central processing unit (CPU) 904 operates the paper discharging tray motor 931 so that the paper discharging tray 501*a* is lowered. This lowering operation is continuously performed until an input from the paper discharging level sensor 505 shows a value corresponding to a nonexistence of the transfer paper sheet. A height of transfer paper sheets on the paper discharging tray 501*a* is set to a constant height even when a stacking amount of the transfer paper sheets is increased. Accordingly, the transfer paper sheet is stably discharged onto the paper discharging tray 501*a* at any time.

As mentioned above, in the embodiment 2, the CCD sensor 604 detects an existence or nonexistence of the seal print as an unremoved image left on a surface of the transfer paper sheet 10 after toner is separated from this transfer paper sheet. When the seal print is left on the transfer paper sheet, the transfer paper sheet 10 is coated with an ink blotting agent as the processing liquid 24 so that the seal print is blotted and cannot be recognized. Thus, no seal print can be recognized on the transfer paper sheet 10 even when the transfer paper sheet 10 is thrown away in error, etc. Accordingly, it is possible to prevent the transfer paper sheet having the left seal print from being abused, altered and forged in advance.

In the above embodiment 2, the transfer paper sheet 10 is automatically sorted by the sorting unit 40. The transfer paper sheet lob having an unremoved image such as a toner image, a seal print, etc. is discharged onto the paper discharging tray 501*b* of the paper receiving unit 5. The transfer paper sheet 10*a* completely removing an image therefrom is discharged onto the paper discharging tray 501*a*. Accordingly, it is not necessary to manually perform a sorting operation for subsequent processings about necessariness or unnecessariness of reuse, paper cutting for holding secret information, etc.

Further, in the embodiment 2, the seal print on the transfer paper sheet 10 is detected by the CCD sensor 604 after the toner removing processing. After the transfer paper sheet is stamped by a stamp, a color copy of an original seal print is made so that a copied color transfer paper sheet is obtained. No copied color transfer paper sheet is coated with the processing liquid 24 such as the above ink blotting agent, etc. in error after the toner removing processing is performed with respect to this copied color transfer paper sheet so as to completely remove a toner image including the copied seal print from the copied color transfer paper sheet. Namely, this transfer paper sheet can be coated with the processing liquid 24 only when it is difficult to remove the original seal print from the color transfer paper sheet by the above toner removing processing and this original seal print is left on the transfer paper sheet.

Further, in the embodiment 2, the left seal print is blotted by coating the transfer paper sheet 10 having the left seal print with the ink blotting agent as the processing liquid 24. Therefore, the transfer paper sheet 10*b* having the left seal print can be easily discriminated from the transfer paper sheet 10*a* completely removing an image therefrom. Accordingly, it is possible to prevent the transfer paper sheet 10*b* having the left unremoved image from being reused in error by discriminating the transfer paper sheets from each other. Further, it is possible to prevent the transfer paper sheet 10*b* having the left unremoved image from being thrown away in error. Therefore, a leakage of secret information can be prevented in advance and it is possible to prevent the transfer paper sheet 10*b* having the left unremoved image such as a stamp, a signature, etc. from being abused, altered and forged in advance.

In the above embodiment 2, the transfer paper sheet 10 having the left seal print is coated with the ink blotting agent as the processing liquid 24 by using the coating roller 207*c* after toner is separated from the transfer paper sheet 10. However, the transfer paper sheet 10 may be coated with the processing liquid 24 by using the printing unit of an ink jet type shown in FIG. 4 or 5 in the above embodiment 1. In this case, an operation of the printing unit may be controlled such that an entire face of the transfer paper sheet 10 is coated with the processing liquid 24. Otherwise, the operation of the printing unit may be controlled such that only the unremoved image left on the transfer paper sheet 10 is coated with the processing liquid 24.

In the above embodiment 2, a liquid for blotting the seal print is used as the processing liquid 24. Ink having the same color as the unremoved image on the transfer paper sheet 10 may be used as the processing liquid 24 instead of the blotting liquid. In this case, an entire face of the transfer paper sheet 10 or only the unremoved image may be coated with this ink as the processing liquid 24. For example, red ink is used as the processing liquid 24 with respect to a red seal print normally used in most cases. An opaque material such as a white material, etc. may be used as the processing liquid 24 instead of the above liquid for blotting the seal print. In this case, an entire face of the transfer paper sheet 10 or only the unremoved image may be coated with this opaque material as the processing liquid 24.

In the above embodiment 2, the unremoved image left on the transfer paper sheet is constructed by the seal print as a red image. However, the present invention is not limited to this seal print. For example, the present invention can be also applied to a case in which a seal print except for the red image, an image additionally written with a sign pen, a ball-point pen, a lead pencil, a red pencil, etc. are left on the transfer paper sheet. In this case, kinds of the processing liquid 24 are selected in accordance with kinds of the unremoved image.

In the above embodiment 2, the CCD sensor 604 detects an existence or nonexistence of the unremoved image such as the seal print on the transfer paper sheet 10 after the toner removing processing. However, the above transfer paper sheet state sensor 106 instead of the CCD sensor 604 may detect the existence or nonexistence of the unremoved image such as the seal print before the toner removing processing. In this case, an operation of the liquid providing portion 2*c* with respect to the processing liquid 24 may be controlled by using data of this detection.

Embodiment 3

The next description relates to a toner removing apparatus in accordance with an embodiment 3 of the present invention. In this embodiment 3, toner can be removed from both front and rear faces of a transfer paper sheet by circulating and conveying the transfer paper sheet while the front and rear faces of the transfer paper sheet are inverted within the toner removing apparatus.

Figure 11:
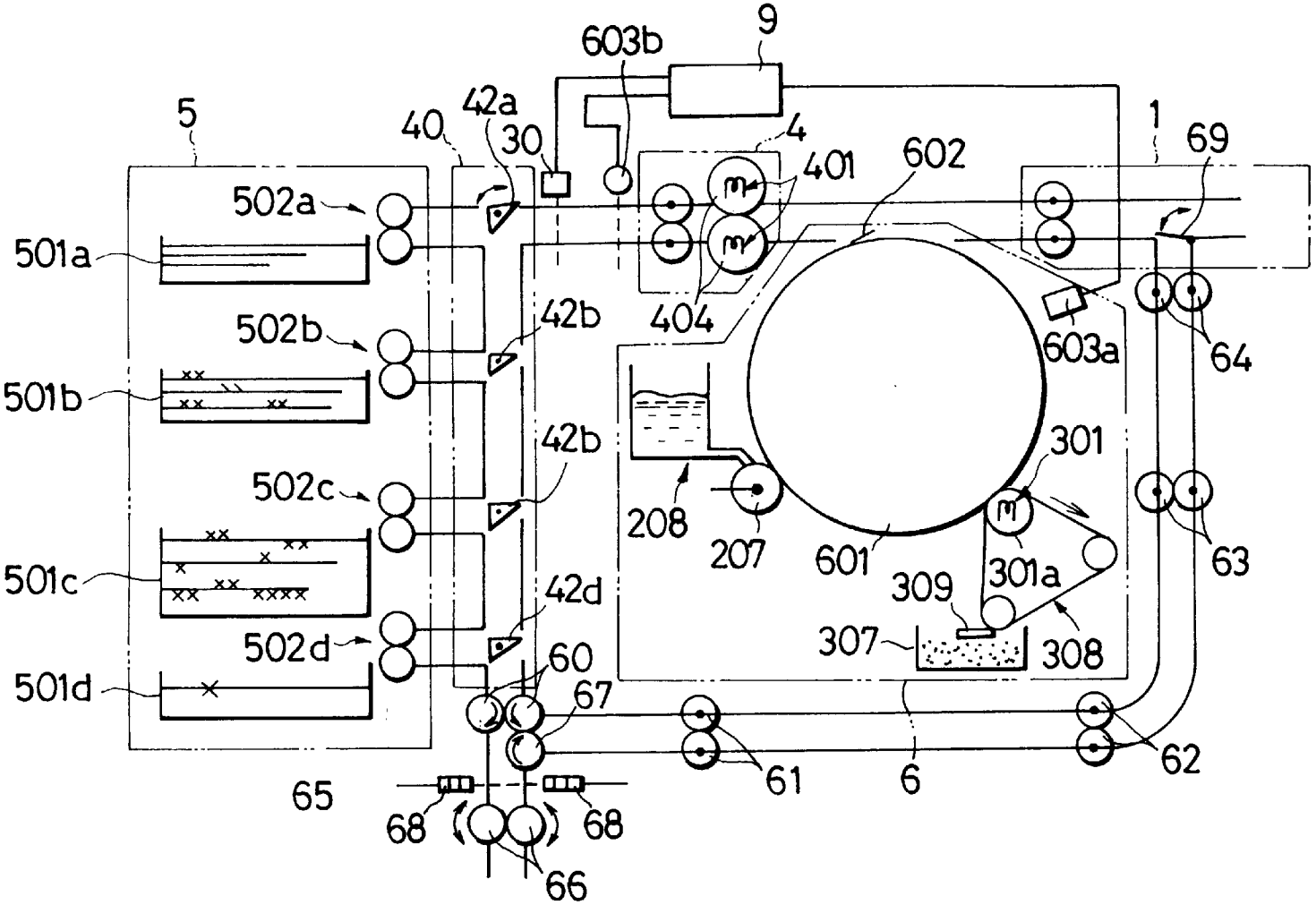
FIG. 11 is a front view showing the schematic construction of a toner removing apparatus in accordance with an Embodiment 3 of the present invention.

In FIG. 11, this toner removing apparatus basically has a construction similar to that of the above-mentioned toner removing apparatus in each of the embodiments 1 and 2. The toner is removed from the transfer paper sheet on a paper holding drum 601 by an operation similar to that of the above-mentioned toner removing apparatus in each of the embodiments 1 and 2. Namely, this toner removing apparatus has a paper feed unit 1 partially omitted in FIG. 11, a liquid providing unit/toner separating unit 6, a drying unit 4, a discriminating mark providing unit 30, a sorting unit 40, a paper receiving unit 5, etc. The liquid providing unit/toner separating unit 6 supplies a liquid to a transfer paper sheet 10 fed from the paper feed unit 1 and separates and removes toner from the transfer paper sheet 10 having the supplied liquid. The drying unit 4 dries the transfer paper sheet 10 from which the toner is removed. The discriminating mark providing unit 30 as a discriminating mark providing means provides a discriminating mark to the transfer paper sheet 10 conveyed from the drying unit 4 in accordance with necessity. The sorting unit 40 sorts the transfer paper sheet 10 from the discriminating mark providing unit 30. The paper receiving unit 5 receives the transfer paper sheet 10 sorted by the sorting unit 40. For example, the toner removing apparatus has an electric mounting portion similar to that shown in FIG. 2 and an operation of this electric mounting portion is basically similar to that in FIG. 2.

In the example shown in FIG. 11, a liquid supplying device 208 of the liquid providing unit/toner separating unit 6 supplies only a processing liquid 20 to a coating roller 207. A separating belt 308 is used instead of the separating roller 302 in the toner removing apparatus shown in FIG. 1. This separating belt 308 is supported by a plurality of supporting rollers including a supporting roller 301*a*. The supporting roller 301*a* has a lamp 301 therein and is opposed to the paper holding drum 601. A cleaning blade 309 and a toner collecting container 307 are additionally arranged near this separating belt 308. The paper receiving unit 5 has first to fourth paper discharging trays 501*a* to 501*d*. The sorting unit 40 has first to fourth deflecting claws 42*a* to 42*d* respectively corresponding to the first to fourth paper discharging trays 501*a* to 501*d*. Sorting and discharging operations, etc. of the transfer paper sheet using these four paper discharging trays and these four deflecting claws will be described later in detail.

In this embodiment, the toner removing apparatus has a circulative conveying path with respect to the transfer paper sheet having toner images on front and rear faces thereof and constructed such that toner can be automatically removed from both the front and rear faces. With respect to this circulative conveying path, the toner removing processing is performed on one face of the transfer paper sheet by the liquid providing unit/toner separating unit 6. Then, the front and rear faces of the transfer paper sheet are inverted and this transfer paper sheet is again fed into the liquid providing unit/toner separating unit 6. In a concrete construction of the circulative conveying path, the transfer paper sheet passes through the sorting unit 40 as it is by switching control of positions of the first to fourth deflecting claws 42*a* to 42*d* in the sorting unit 40 without deflecting the transfer paper sheet on any side of the paper discharging trays 501*a* to 501*d*. A plurality of conveying rollers 60 to 64 and a guide plate constitute the circulative conveying path for again feeding the transfer paper sheet passing through the sorting unit 40 into the liquid providing unit/toner separating unit 6. A switchback path 65 for inverting the front and rear faces of the transfer paper sheet is formed in a portion of this circulative conveying path. Concretely, the switchback path 65 is formed by a normal-reverse conveying roller 66, a driven roller 67, a guide plate, etc. The normal-reverse conveying roller 66 can be rotated in normal and reverse directions. The driven roller 67 comes in contact with one roller of a conveying roller pair 60 located just after the sorting unit 40. A paper sensor 68 is arranged in this switchback path 65 to control rotation of the normal-reverse conveying roller 66. For example, the paper sensor 68 is constructed by an optical sensor or photodetector, etc. for detecting front and rear ends of the transfer paper sheet. A guide claw 69 is arranged in a terminal end portion of the above circulative conveying path. The guide claw 69 can be displaced to commonly use a portion of a conveying path from an unillustrated cassette of the paper feed unit 1 to the paper holding drum 601 as a conveying path from the circulative path to the paper holding drum 601.

In accordance with the above construction, similar to the toner removing apparatus relative to each of the above embodiments 1 and 2, the transfer paper sheet 10 is fed from the paper feed unit 1 and toner is removed from only one of the front and rear faces of the transfer paper sheet 10 on the paper holding drum 601. Thereafter, the transfer paper sheet 10 passes through the sorting unit 40 and the circulative conveying path. The transfer paper sheet 10 is again fed to the liquid providing unit/toner separating unit 6 in a state in which the front and rear faces of the transfer paper sheet 10 are inverted. Thus, the toner removing processing can be also performed with respect to the other of the front and rear faces.

In this embodiment, similar to the toner removing apparatus relative to each of the above embodiments 1 and 2, it is possible to prevent problems from being caused when an image formed on each of the front and rear faces of the transfer paper sheet includes a seal print, handwritten characters written with a sign pen, etc., and the seal print, the handwritten characters, etc. cannot be removed from the transfer paper sheet by the toner removing processing and are left as an unremoved image on the transfer paper sheet. Further, this toner removing apparatus is improved to efficiently reuse the transfer paper sheet specially having images on both the front and rear faces.

The transfer paper sheet having images on the front and rear faces is generally divided into three kinds of transfer paper sheets. A first transfer paper sheet can be reused as a transfer paper sheet for a double faced record by removing the images from the front and rear faces. With respect to a second transfer paper sheet, there is a possibility that an unremoved image is left on only one of the front and rear faces and the other face can be reused to record an image. No third transfer paper sheet can be reused since an unremoved image is left on each of the front and rear faces. The second transfer paper sheet having the unremoved image on at least one of the front and rear faces can be further generally divided into a paper sheet having a high possibility of abuse of the unremoved image such as a seal print and a paper sheet having a low possibility of abuse of the unremoved image such as a seal print. Accordingly, the transfer paper sheet having images on the front and rear faces is finely classified into the following four paper sheets in combination with the above viewpoints.

(1) A paper sheet reusable as a transfer paper sheet for a double faced record by removing images from the front and rear faces;

(2) A paper sheet having only an unremoved image having a low possibility of abuse on only one of the front and rear faces and having the other face reusable as it is;

(3) A paper sheet which cannot be reused as it is since only an unremoved image having a low possibility of abuse is left on each of the front and rear faces;

(4) A paper sheet requiring processings for preventing abuse, etc. since a seal print having a high possibility of abuse is left on at least one of the front and rear faces.

In this embodiment, it is judged whether the transfer paper sheet is one of the above four paper sheets from (1) to (4). Predetermined processings are performed with respect to this transfer paper sheet in accordance with necessity. Thereafter, as mentioned above, the transfer paper sheet is stored into one of the four paper discharging trays 501*a* to 501*d*. For example, a punched hole is formed by the discriminating mark providing unit 30 with respect to the transfer paper sheet (4) requiring processings for preventing abuse, etc.

Figure 12:
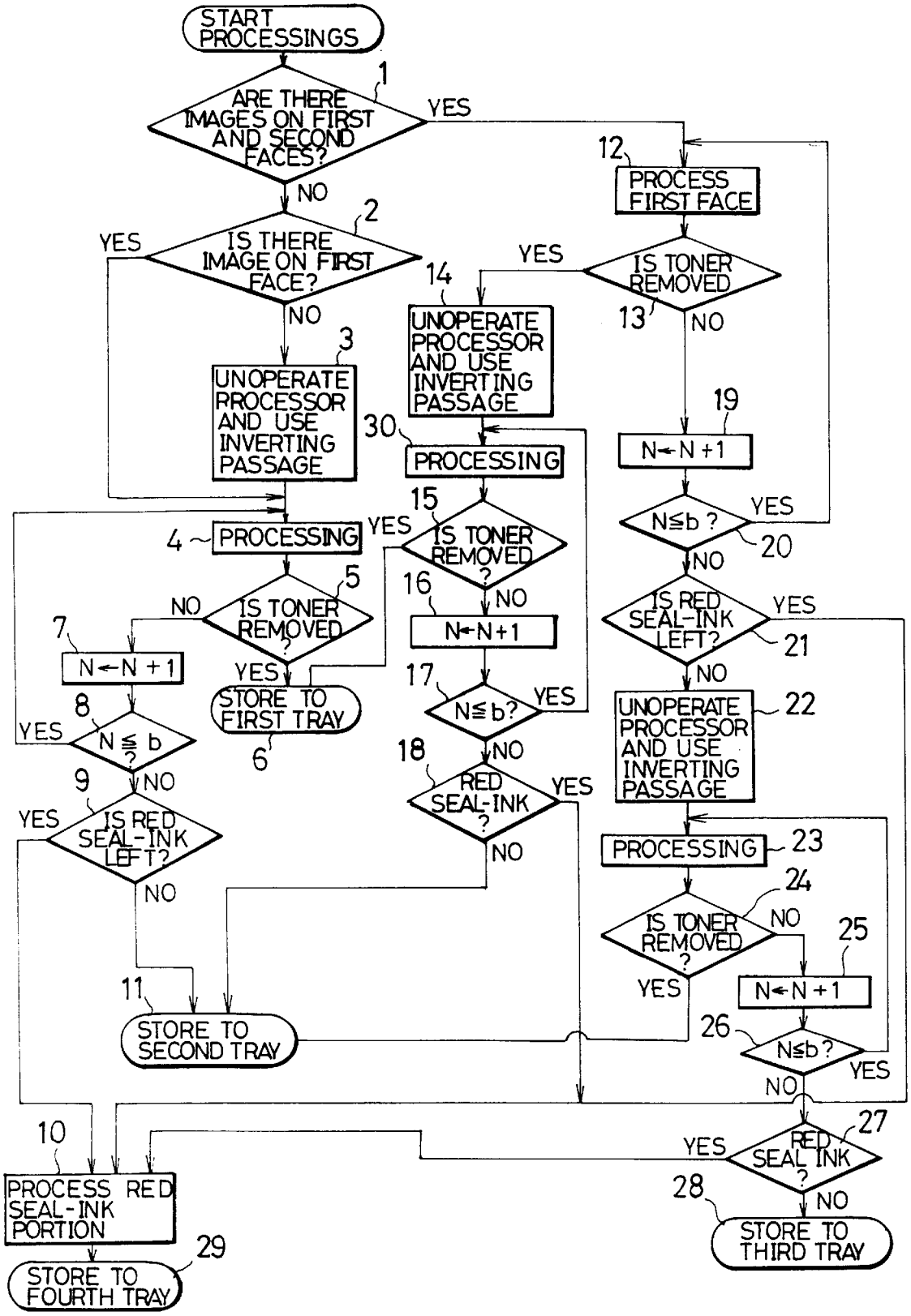
FIG. 12 is a flow chart showing control of the toner removing apparatus shown in FIG. 11.

FIG. 12 shows one example of control for performing such an operation of the toner removing apparatus.

In a step 1 shown in FIG. 12, it is judged whether an image is formed or not on each of upper and lower faces of a transfer paper sheet when the transfer paper sheet is fed from the paper feed unit 1. The upper face of the transfer paper sheet is called a first face in the following description.

The lower face of the transfer paper sheet is called a second face in the following description. A sensor for detecting an existence or nonexistence of the image may be arranged such that this sensor is opposed to each of the first and second faces. In this case, the existence or nonexistence of the image is judged by using a signal from this sensor. Otherwise, the existence or nonexistence of the image may be judged by using an input signal provided by a ten key input from an operating section by an operator in advance.

When it is judged that there are no images on both the first and second faces of the transfer paper sheet, the judgment in the step 1 is NO. Namely, it is judged that an image is formed on only one of the first and second faces. In this case, in a step 2, it is judged whether the image is formed on the first face. When the image is formed on the first face, this transfer paper sheet is held on the paper holding drum 601 by the clamping claw 602 as it is. The paper holding drum 601 is then rotated one time and toner removing processing is performed in a step 4. In a step 5, it is judged by using an output of the CCD sensor 603*a* whether an unremoved image is left on the transfer paper sheet or not.

When no unremoved image is left on the transfer paper sheet, the judgment in the step 5 is YES. In this case, the transfer paper sheet is separated from the paper holding drum 601 by opening the clamping claw 602. The transfer paper sheet is then dried by the drying unit 4 and passes through the discriminating mark providing unit 30 in an unoperated state. The transfer paper sheet is discharged onto the first paper discharging tray 501*a* by the first deflecting claw 42*a* of the sorting unit 40. The transfer paper sheet is thus stored to the first paper discharging tray 501*a* in a step 6. In contrast to this, when the unremoved image is left on the transfer paper sheet, the judgment in the step 5 is NO. In this case, a counter N for counting the number of continuous toner processings counts up. In steps 4, 5, 7 and 8, while it is judged whether the number of continuous toner processings exceeds a predetermined number b or not, the toner removing processing and a checking operation using the output of the CCD sensor 603*a* are repeatedly performed. In the meantime, when it is judged that no unremoved image is left on the transfer paper sheet, the judgment in the step 5 is YES. The transfer paper sheet is similarly discharged and stored to the first paper discharging tray 501*a*.

In contrast to this, when the number of continuous toner processings exceeds the predetermined number b while the unremoved image is left on the transfer paper sheet, the transfer paper sheet is separated from the paper holding drum 601 by opening the clamping claw 602. The transfer paper sheet is then dried by the drying unit 4. In a step 9, it is judged whether this unremoved image is a seal print or not by judging an existence or nonexistence of a circular or square shape, etc. using an output of the CCD sensor 603*b*. It may be judged by commonly using the CCD sensor 603*a* and the CCD sensor 604 sensitive to red or a color close to red as shown in the toner removing apparatus of FIG. 7 whether or not the unremoved image is a seal print formed in red seal-ink from a shape and a color.

When the seal print is left on the transfer paper sheet, the judgment in the step 9 is YES. In this case, for example, a punched hole is formed by operating the discriminating mark providing unit 30 in a step 10 such that the punched hole overlaps the seal print or does not overlap the seal print. A mark such as o, x, etc. may be printed by operating the discriminating mark providing unit 30. Further, a solid image is formed by operating the discriminating mark providing unit 30 such that the entire seal print is covered with this image. Otherwise, the transfer paper sheet may be coated with a special liquid by operating the discriminating mark providing unit 30 such that the seal print is blotted. Thereafter, in a step 29, the transfer paper sheet is discharged and stored to the fourth paper discharging tray 501*d* by the fourth deflecting claw 42*d* of the sorting unit 40.

In contrast to this, when it is judged that no seal print is left on the transfer paper sheet, the transfer paper sheet passes through the discriminating mark providing unit 30 in an unoperated state. The transfer paper sheet is then discharged and stored to the second paper discharging tray 501*b* by the second deflecting claw 42*b* of the sorting unit 40. In this case, the first face having the unremoved image of the transfer paper sheet on the second paper discharging tray 501*b* is directed upward.

The above description relates to processings in a case in which an image is formed on only the first face of the transfer paper sheet. When it is judged in the above step 2 that an image is formed on only the second face, the judgment in this step 2 is NO. In this case, the transfer paper sheet also passes through the drying unit 4 in an unoperated state, the discriminating mark providing unit 30 and the sorting unit 40 without holding the transfer paper sheet by the paper holding drum 601 just after this judgment in the step 2. Front and rear faces of the transfer paper sheet are inverted on the circulative path. Thereafter, the operation of the toner removing apparatus is similar to the above-mentioned operation except that the transfer paper sheet is held by the paper holding drum 601. Namely, when the image can be removed from the second face of the transfer paper sheet, the transfer paper sheet is stored to the first paper discharging tray 501*a*. Then, the toner removing processing is repeatedly performed in a range in which the number of continuous toner processings does not exceed a predetermined number. When no image can be removed from the second face and an unremoved image is left on the second face and includes a seal print in this toner removing processing, predetermined processings are performed by the discriminating mark providing unit 30 with respect to this transfer paper sheet. Thereafter, the transfer paper sheet is discharged and stored to the fourth paper discharging tray 501*d*. In contrast to this, when no image can be removed from the second face by repeating the toner removing processing in the above range and an unremoved image is left on the transfer paper sheet and does not include a seal print, the transfer paper sheet is discharged and stored to the second paper discharging tray 501*b*. This transfer paper sheet having the unremoved image on the second face is stored onto the second paper discharging tray 501*b* in a state in which the unremoved image is directed upward on the second paper discharging tray 501*b*.

When it is judged that an image is formed on each of the front and rear faces of the transfer paper sheet, the judgment in the step 1 is YES. An explanation of this judgment will next be described. In this case, in a step 12, the toner removing processing is first started with respect to the first face. In steps 13, 19, 20 and 12, the toner removing processing with respect to the first face is performed in a range in which the number of continuous toner processings does not exceed a predetermined number b. When the image can be removed from the first face, the judgment in the step 13 is YES. In steps 14, 30, 15, 16 and 17, the toner removing processing is started with respect to the second face. When this toner removing processing with respect to the second face is started, the clamping claw 602 is once opened so that the transfer paper sheet is separated from the paper holding drum 601. The transfer paper sheet passes through the drying unit 4 in an unoperated state, the discriminating mark providing unit 30 and the sorting unit 40. Front and rear faces of the transfer paper sheet are inverted on the circulative path in the step 14. Thereafter, in the steps 30, 15, 16 and 17, the transfer paper sheet is held by the paper holding drum 601 and the toner removing processing is performed with respect to this transfer paper sheet in the range in which the number of continuous toner processings does not exceed the predetermined number b.

When the image can be also removed from the second face by the toner removing processing with respect to the second face, the judgment in the step 15 is YES. In this case, the transfer paper sheet is separated from the paper holding drum 601 by opening the clamping claw 602. The transfer paper sheet is then dried by the drying unit 4 and passes through the discriminating mark providing unit 30 in an unoperated state. In the step 6, the transfer paper sheet is discharged and stored to the first paper discharging tray 501*a* by the first deflecting claw 42*a* of the sorting unit 40.

In contrast to this, there is a case in which no image can be removed from the second face by repeating the toner removing processing with respect to the second face in the range in which the number of continuous toner processings does not exceed the predetermined number. In this case, an unremoved image is left on the second face so that the judgment in the step 17 is NO. When the unremoved image left on the second face includes a seal print, the judgment in the step 18 is YES. In this case, similar to the above step 10, predetermined processings with respect to the transfer paper sheet are performed by operating the discriminating mark providing unit 30 in the step 10. Thereafter, the transfer paper sheet is discharged and stored to the fourth paper discharging tray 501*d* by the fourth deflecting claw 42*d* of the sorting unit 40 in the step 29. The unremoved image is left on the second face since no image can be removed from the second face by repeating the toner removing processing with respect to the second face in the range in which the number of continuous toner processings does not exceed the predetermined number. Accordingly, the judgment in the step 17 is NO. When this unremoved image left on the second face does not include a seal print, the judgment in the step 18 is NO. In this case, the transfer paper sheet passes through the discriminating mark providing unit 30 in an unoperated state. The transfer paper sheet is then discharged and stored to the second paper discharging tray 501*b* by the second deflecting claw 42*b* of the sorting unit 40. In this case, the second face having the unremoved image of the transfer paper sheet on the second paper discharging tray 501*b* is directed upward.

A judgment in a step 26 is NO when the unremoved image is left on the first face since no image can be removed from the first face by repeating the toner removing processing with respect to the first face in the range in which the number of continuous toner processings does not exceed the predetermined number. In this case, starting of the toner removing processing with respect to the second face is determined in accordance with a situation as to whether the unremoved image includes a seal print or not. Namely, when the unremoved image includes the seal print, a judgment in a step 27 is YES. In this case, no toner removing processing with respect to the second face is performed. Similar to the above step 10, predetermined processings of the transfer paper sheet are then performed in the step 10 by operating the discriminating mark providing unit 30. Thereafter, the transfer paper sheet is discharged and stored to the fourth paper discharging tray 501*d* by the fourth deflecting claw 42*d* of the sorting unit 40 in the step 29.

In contrast to this, when no unremoved image includes the seal print, the clamping claw 602 is once opened so that the transfer paper sheet is separated from the paper holding drum 601. The transfer paper sheet then passes through the drying unit 4 in an unoperated state, the discriminating mark providing unit 30 and the sorting unit 40. Front and rear faces of the transfer paper sheet are inverted on the circulative path in a step 22. Thereafter, the transfer paper sheet is held by the paper holding drum 601. In steps 23, 24, 25 and 26, the toner removing processing with respect to the second face is then started in the range in which the number of continuous toner processings does not exceed the predetermined number b.

When the image can be removed from the second face by the toner removing processing with respect to the second face, the judgment in the step 24 is YES. In this case, the transfer paper sheet is separated from the paper holding drum 601 by opening the clamping claw 602. The transfer paper sheet is then dried by the drying unit 4 and passes through the discriminating mark providing unit 30 in an unoperated state. In a step 11, the transfer paper sheet is discharged and stored to the second paper discharging tray 501*b* by the second deflecting claw 42*b* of the sorting unit 40.

In this case, the unremoved image is left on only the first face of the transfer paper sheet. Accordingly, when the transfer paper sheet is discharged onto the second paper discharging tray 501*b* as it is after the toner removing processing with respect to the second face, the first face having the unremoved image is directed downward on the second paper discharging tray 501*b*. However, in this case, a paper sheet side of the unremoved image is reverse to that of the above transfer paper sheet having an image on only one face and stored to the paper discharging tray 501*b* in a state in which this image cannot be removed from this transfer paper sheet. The paper sheet side of the unremoved image is also reverse to that of a transfer paper sheet having images on front and rear faces thereof and stored to the paper discharging tray 501*b* in a state in which only an image on the second face cannot be removed therefrom. Accordingly, it is necessary to manually arrange directions of reusable paper faces when the transfer paper sheet is reused. Therefore, it is desirable to invert the front and rear faces of the transfer paper sheet so as to omit such an arrangement before the transfer paper sheet in this case is discharged to the second paper discharging tray 501*b*. For example, the transfer paper sheet passes through the sorting unit 40 and the circulative path before the transfer paper sheet is discharged to the paper discharging tray 501*b*. After the front and rear faces of the transfer paper sheet are inverted, the transfer paper sheet is discharged to the paper discharging tray 501*b*. Conversely, the front and rear faces of the transfer paper sheet may be inverted at a discharging time thereof such that a paper face of the unremoved image is directed and arranged downward on the paper discharging tray 501*b*. In this case, the transfer paper sheet is stored to the paper discharging tray 501*b* in a state in which the transfer paper sheet has an image on only one face and this image cannot be removed from this transfer paper sheet. Further, the transfer paper sheet is stored to the paper discharging tray 501*b* in a state in which the transfer paper sheet has images on the front and rear faces and only an image on the second face cannot be removed therefrom.

In contrast to this, when no image on the second face can be removed therefrom by repeating the toner removing processing with respect to the second face in the range in which the number of continuous toner processings does not exceed the predetermined number, an unremoved image is left on the second face so that the judgment in the step 26 is NO. When the unremoved image left on the second face includes a seal print, the judgment in the step 27 is YES. In this case, similar to the above step 10, predetermined processings of the transfer paper sheet are performed in the step 10 by operating the discriminating mark providing unit 30. Thereafter, the transfer paper sheet is discharged and stored to the fourth paper discharging tray 501*d* by the fourth deflecting claw 42*d* of the sorting unit 40 in the step 29. As mentioned above, when no image on the second face can be removed therefrom by repeating the toner removing processing with respect to the second face in the range in which the number of continuous toner processings does not exceed the predetermined number, the unremoved image is left on the second face so that the judgment in the step 26 is NO. When the unremoved image left on the second face does not include any seal print, the judgment in the step 27 is NO. In this case, the transfer paper sheet passes through the discriminating mark providing unit 30 in an unoperated state. The transfer paper sheet is then discharged and stored to the third paper discharging tray 501*c* by the third deflecting claw 42*c* of the sorting unit 40.

As mentioned above, in accordance with this embodiment, the toner removing apparatus has the circulative path for inverting the front and rear faces of the transfer paper sheet so that an image can be removed from each of the front and rear faces of the transfer paper sheet.

The transfer paper sheet reusable by the toner removing processing with respect to only one paper face is stored to the second paper discharging tray 501*b*. The transfer paper sheet having an unremoved image on each of the front and rear faces and unable to be reused with respect to each of the front and rear faces is stored to the third paper discharging tray 501*c*. Thus, these transfer paper sheets are separately stored to the paper discharging trays so that it is not necessary to manually sort these transfer paper sheets. Accordingly, the former transfer paper sheet can be easily reused in comparison with a case in which both the transfer paper sheets are stored to a paper discharging tray together.

When the transfer paper sheet reusable with respect to only one paper face is stored to the third paper discharging tray 501*b*, the transfer paper sheet is stored such that the unremoved image on the transfer paper sheet is arranged and directed on the same side. Accordingly, it is not necessary to manually arrange the direction of a reusable face of the transfer paper sheet while the front and rear faces of the transfer paper sheet are inverted at a reusing time thereof. Therefore, the transfer paper sheet can be easily reused.

Further, the transfer paper sheet is stored such that the above one face of the transfer paper sheet is directed upward. Accordingly, contents of the unremoved image can be easily confirmed from above in a state in which the paper discharging tray 501*b* is detached from the toner removing apparatus in accordance with necessity.

When the unremoved image is constructed by a seal print, the predetermined processings are performed by the discriminating mark providing unit 30 with respect to the transfer paper sheet. Accordingly, it is possible to prevent the transfer paper sheet having the left seal print from being abused.

When an unremovable seal print is left on a first toner-removed face of the transfer paper sheet having images on the front and rear faces, this transfer paper sheet is stored without performing the toner removing processing with respect to the other paper face. Accordingly, a time for processing the transfer paper sheet not to be reused can be shortened in comparison with a case in which the toner removing processing is performed with respect to both the front and rear faces.

The transfer paper sheet having the unremovable seal print is stored to the fourth paper discharging tray 501*d*. The transfer paper sheet having an unremovable image except for the seal print on only one paper face is stored to the second paper discharging tray 501*b*. The transfer paper sheet having an unremovable image except for the seal print on each of the front and rear faces is stored to the third paper discharging tray 501*c*. Accordingly, these transfer paper sheets are separately stored to the paper discharging trays. Therefore, it is not necessary to manually perform a sorting operation for subsequent processings about necessariness or unnecessariness of reuse, paper cutting for holding secret information, etc.

In the above embodiment, when the unremoved image includes a seal print, this seal print may be colored in the same color as the transfer paper sheet so that a paper face having the seal print can be also reused. In this case, for example, the toner removing apparatus uses a means for detecting a color of the transfer paper sheet and a printing unit having an ink jet nozzle and coloring the seal print in a color close to the detected color among plural colors of ink prepared in advance.

In the above embodiment, it is judged whether only the seal print is included in the unremoved image or not. However, instead of this judgment or in addition to this judgment, it may be judged whether or not the unremoved image includes handwritten characters written with a writing tool such as a sign pen, etc. In this case, the transfer paper sheet may be stored in a different place in accordance with results of this judgment. The inclusion of such handwritten characters can be judged by judging whether or not the unremoved image is formed on only a portion of the entire transfer paper sheet. This judgment is made by using that characters are manually written on only a portion of the entire transfer paper sheet in most cases, but a copy using an electrophotographic copying machine, etc. is made with respect to the entire transfer paper sheet in most cases.

Figure 13:
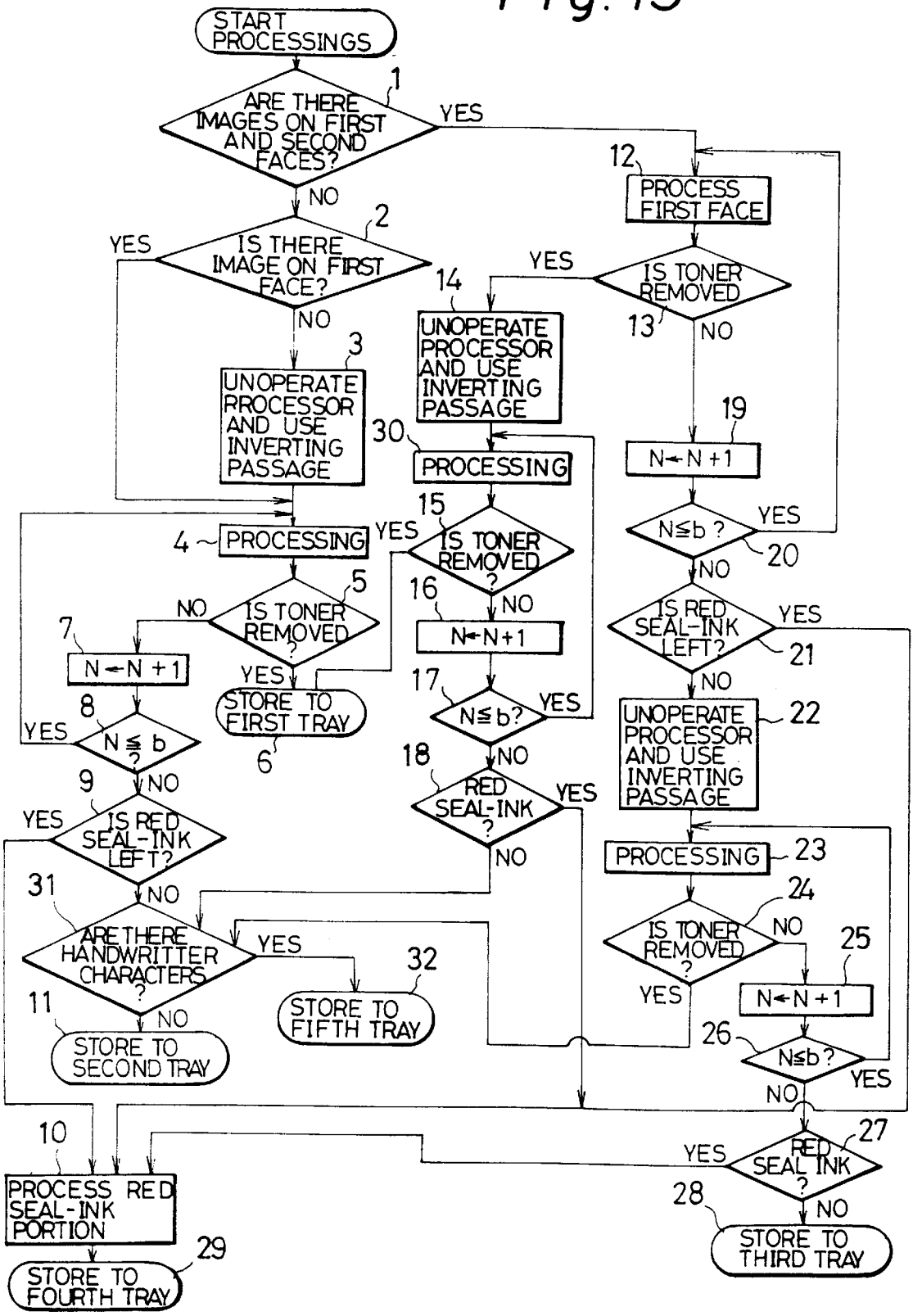
FIG. 13 is a flow chart showing another example of this control of the toner removing apparatus shown in FIG. 11.

Therefore, for example, the handwritten characters are judged by using an output of the CCD sensor 603*b* for detecting a transfer paper sheet face after the toner removing processing in FIG. 11 according to whether or not the unremoved image is partially formed on only a portion of the entire transfer paper sheet. FIG. 13 is a flow chart showing one example of such control. In this example, it is judged in a step 31 whether or not an unremoved image left on only one face of the transfer paper sheet does not include a seal print and is formed by handwritten characters. When no unremoved image is formed by the handwritten characters, the unremoved image is formed by a normal electrophotographic copying machine, etc. In this case, the transfer paper sheet is stored to the second paper discharging tray 501*b*. In contrast to this, when the unremoved image is formed by handwritten characters, the transfer paper sheet is stored to an unillustrated fifth paper discharging tray separated from the first to fourth paper discharging trays 501*a* to 501*d*.

Transfer paper sheets can be separately stored to the paper discharging trays in accordance with such control for judging whether the unremoved image is formed by handwritten characters or not. These transfer paper sheets include a transfer paper sheet having an unremoved image such as an image of a lead pencil unable to be completely removed by repeating the toner removing processing using the toner removing system of the present invention. These transfer paper sheets also include a transfer paper sheet having an unremoved image formed by an electrophotographic system and left since the number of continuous separating processings is limited to prevent fibers of the transfer paper sheet from being excessively damaged as in the above embodiments. It is not necessary to manually sort both the transfer paper sheets when the toner removing processing is performed by slightly allowing damage of fibers of the latter transfer paper sheet having the unremoved image formed by the electrophotographic system and resetting this latter transfer paper sheet in a paper feed cassette of the toner removing apparatus. In many cases, distributed materials with respect to important conferences are made by using an electrophotographic copying machine, etc. In these cases, when the transfer paper sheet having the unremoved image as high secret information is cut, etc., no manual sorting operation is required between this transfer paper sheet and a transfer paper sheet having only unremovable handwritten characters.

In accordance with such control, the transfer paper sheet having an unremoved image except for handwritten characters and a seal print on only one paper face is stored to the second paper discharging tray 501*b*. The transfer paper sheet having an unremoved image of handwritten characters on only one paper face is stored to the fifth paper discharging tray. The transfer paper sheet having an unremovable image on each of the front and rear paper faces is stored to the third paper discharging tray 501*c*. Thus, the transfer paper sheets are separately stored to the paper discharging trays. Accordingly, it is not necessary to manually perform a sorting operation for subsequent processings about necessariness or unnecessariness of reuse, paper cutting for holding secret information, etc.

There is a possibility that the transfer paper sheet stored to the fifth paper discharging tray includes high secret information. Accordingly, a shredder may be additionally arranged in the toner removing apparatus. In this case, a transfer paper sheet conveying path from the toner removing apparatus to the shredder is formed so that the transfer paper sheet is cut by the shredder as it as without storing this transfer paper sheet to the fifth paper discharging tray.

In the above embodiment, the CCD sensor 603*b* detects a face of the transfer paper sheet separated from the paper holding drum 601 after the toner removing processing. An existence or nonexistence of a seal print is judged by using data of this detection. However, the existence or nonexistence of the seal print may be detected by using data from the CCD sensor 603*a* for detecting a face of the transfer paper sheet on the paper holding drum 601, etc. Further, it may be judged by using detecting data of the transfer paper sheet face before the toner removing processing whether a seal print is included in an image on this transfer paper sheet face or not.

In the above embodiments 1 to 3, the present invention is applied to a transfer paper sheet having at least a fibrous structure on a paper surface on which an image is formed by an electrophotographic copying machine of a transfer type. However, the present invention can be also applied to an image holding member such as recording paper used for another image forming apparatus such as a facsimile telegraph, a printer, etc. Further, the image holding member is not limited to the fibrous structure in the present invention. For example, the present invention can be applied to an image holding member on which an image can be formed. For example, the image holding member using the present invention may be constructed by a laminated material, etc. in which a surface layer of a base sheet such as a plastic layer is formed by paper as a material layer.

In the above embodiments 1 to 3, the transfer paper sheet 10 is coated with the processing liquid 20, etc. before the toner separating process. However, when toner is easily separated from the transfer paper sheet, the toner removing apparatus may be constructed such that the toner is removed from the transfer paper sheet by only the toner separating process without any coating process of the processing liquid 20, etc. In this case, it is not necessary to arrange the above drying unit 4.

Figure 14A:
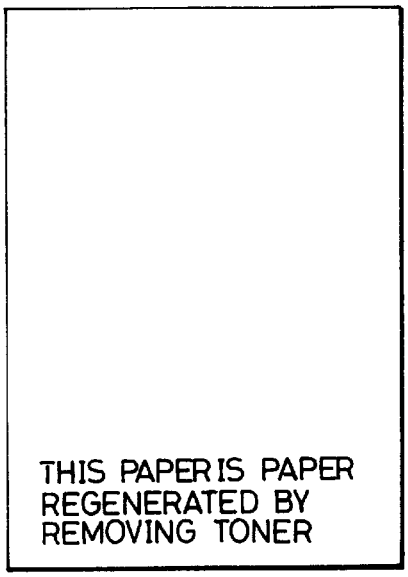
FIGS. 14*a* to 14*d* each show a view for explaining an example of a discriminating mark formed by each of a printing unit and a punching unit.
Figure 14B:
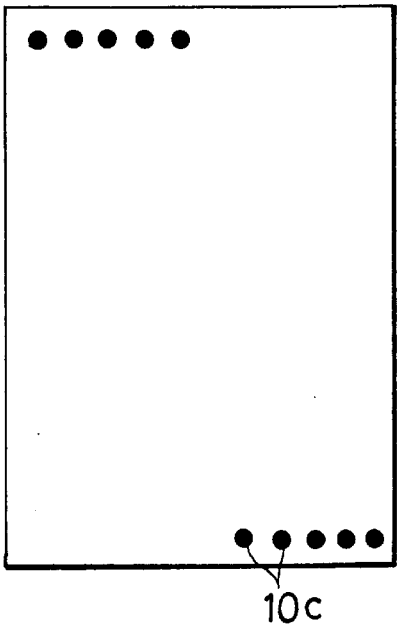
Figure 14C:
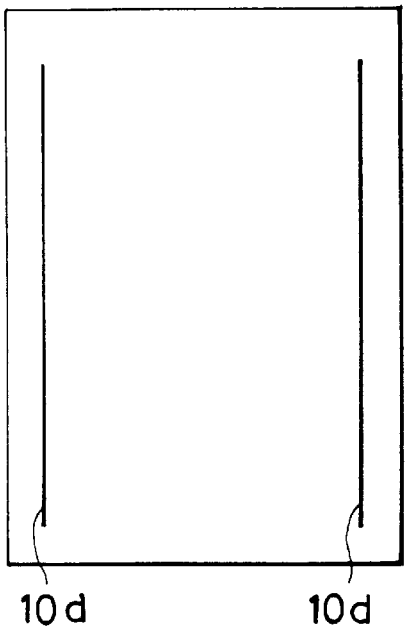

In the above embodiments 1 to 3, processings shown in FIGS. 14*a* to 14*d* may be performed instead of the above-mentioned processings or in addition to the above-mentioned processings with respect to the transfer paper sheet having an unremoved image having a fear of abuse such as a seal print, an image additionally written with a sign pen, a ball-point pen, a lead pencil, a red pencil, etc. In the processing shown in FIG. 14*a*, a display such as "This paper is paper regenerated by removing toner" is printed on an end portion of the transfer paper sheet by a printing unit as shown in each of FIGS. 4 and 5. In the processing shown in FIG. 14*b*, for example, a plurality of small holes 10*c* are formed on a straight line in an end portion of the transfer paper sheet by a punching unit as shown in FIG. 3. In FIG. 14*b*, the plural small holes 10*c* are formed in both upper and lower end portions of the transfer paper sheet. In the processing shown in FIG. 14*c*, a line 10*d* such as a solid line, a broken line, a pattern line, etc. is printed on an end portion of the transfer paper sheet by a printing unit as shown in each of FIGS. 4 and 5. In FIG. 14*c*, the line 10*d* is printed in the vicinity of each of longer sides of the transfer paper sheet. In the processing shown in FIG. 14*d*, for example, an end portion of the transfer paper sheet is cut in a zigzag shape.

Figure 14D:
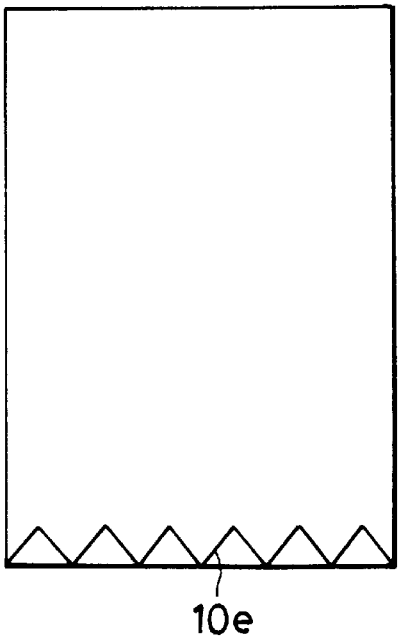

Various kinds of cutting means can be used in the cutting processing shown in FIG. 14*d*. As shown in FIG. 14*d*, the transfer paper sheet is desirably cut such that the contour of a cutting line is in conformity with a contour line 10*e* of the transfer paper sheet having a normal paper size such as A4, B5, etc. The reasons for this are as follows. Namely, in the above embodiments 1 to 3, toner is removed from the transfer paper sheet by providing the processing liquid to the transfer paper sheet. A linear velocity of a conveying roller pair, etc. on a downstream side in a conveying direction of the transfer paper sheet is set to be slightly higher than that on an upstream side so as to prevent wrinkles from being caused by wetting of the transfer paper sheet, etc. Accordingly, the transfer paper sheet is conveyed within the toner removing apparatus in a state in which the transfer paper sheet is slightly tensioned. Therefore, the transfer paper sheet is slightly extended in the conveying direction. Accordingly, when the extended transfer paper sheet is reused, problems are caused. For example, there is a case in which no transfer paper sheet is suitably stored to a cassette for storing the transfer paper sheet in a copying machine. Further, there is a case in which it is not easy to file the transfer paper sheet since a size of the transfer paper sheet is different from another standard size of the transfer paper sheet, etc. when the transfer paper sheet is filed. Accordingly, it is possible to discriminate paper regenerated by removing toner if the transfer paper sheet is cut such that the contour of the cutting line is in conformity with the contour line of the transfer paper sheet having a normal size such as A4, B5, etc. as mentioned above. Further, the above problems can be solved when the transfer paper sheet is stored to a cassette for storing this transfer paper sheet and is filed.

A discriminating mark capable of discriminating paper regenerated by toner removal as shown in each of FIGS. 14*a* to 14*d* may be provided to all transfer paper sheets as toner removed objects irrespective of existence or nonexistence of a seal print, etc. mentioned above.

Figure 15:
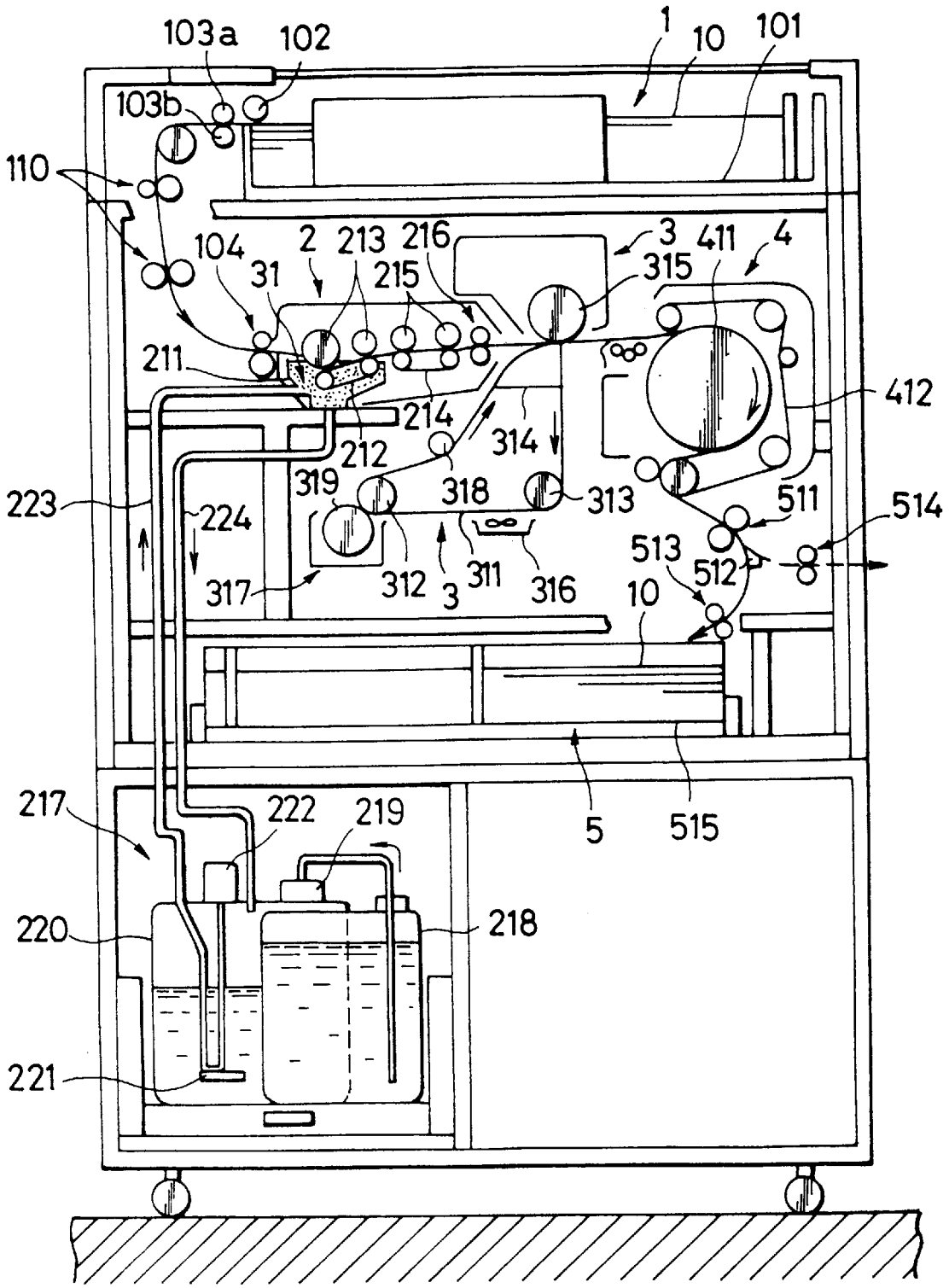
FIG. 15 is a view showing the schematic construction of another example of the toner removing apparatus to which the present invention can be applied.

FIG. 15 shows another constructional example of the toner removing apparatus to which the present invention can be applied. This toner removing apparatus has a paper feed unit 1, a liquid providing unit 2, a toner separating unit 3, a drying unit 4 and a paper receiving unit 5. The paper feed unit 1 separates transfer paper sheets 10 having toner images and stored in a stacking state from each other. The paper feed unit 1 then feeds the transfer paper sheets 10 one by one. The liquid providing unit 2 supplies the above processing liquid 20 to one transfer paper sheet 10 fed from the paper feed unit 1. The toner separating unit 3 separates and removes toner from the transfer paper sheet 10 having the supplied liquid. The drying unit 4 dries the transfer paper sheet 10 from which the toner is removed. The paper receiving unit 5 receives the transfer paper sheet 10 discharged from the drying unit 4.

The paper feed unit 1 feeds the transfer paper sheets 10 stacked on a bottom plate 101 from an uppermost paper sheet by a paper feed roller 102. Overlapped transfer paper sheets are separated from each other by a separating mechanism constructed by a feed roller 103*a* and a separating roller 103*b* so that the paper feed unit 1 feeds only one transfer paper sheet 10. This transfer paper sheet 10 fed from the paper feed unit 1 is conveyed by a conveying roller pair 110 and is then fed to the next liquid providing unit 2 by making a timing adjustment and a skew correction of the transfer paper sheet 10 by a resist roller pair 104.

The liquid providing unit 2 has a liquid container 211, a liquid interior belt conveying portion 212, a brush roller 213, a belt conveying portion 214, a brush roller 215, a wringing roller pair 216, a liquid supplying device 217, an unillustrated driving section, etc. The liquid container 211 is filled with a predetermined amount of the processing liquid 20. The liquid interior belt conveying portion 212 is constructed by a round belt wound around supporting rollers and rotated by these supporting rollers in a state in which the round belt is dipped into the processing liquid 20 of the liquid container 211. The brush roller 213 is opposed to the liquid interior belt conveying portion 212 through the transfer paper sheet 10. The belt conveying portion 214 and the brush roller 215 are arranged such that the belt conveying portion 214 and the brush roller 215 convey the transfer paper sheet 10 having the provided liquid. The wringing roller pair 216 removes a surplus amount of the processing liquid 20 provided to the transfer paper sheet 10. The liquid supplying device 217 supplies the processing liquid 20 to the liquid container 211. The unillustrated driving section operates the liquid interior belt conveying portion 212, etc.

The liquid supplying device 217 is constructed by an exchangeable replenishing liquid bottle 218, a tank 220, a liquid supplying pump 221, a pump motor 212, a liquid supplying pipe 223, a liquid discharging pipe 224, etc. The processing liquid 20 is suitably supplied by an electromagnetic pump 219 from the replenishing liquid bottle 218 to the tank 220. The liquid supplying pump 221 is constructed by a blade pump, etc. arranged within the tank 220. The liquid supplying pump 221 is rotated by the pump motor 212. The liquid supplying pipe 223 is arranged to supply the processing liquid 20 from the liquid supplying pump 221 to the liquid container 211. The liquid discharging pipe 224 is arranged to return the processing liquid 20 discharged from a discharging port arranged in a lower portion of the liquid container 211 into the tank 220. In this construction, the processing liquid 20 fed by the liquid supplying pump 221 is supplied to the liquid container 211 through the liquid supplying pipe 223. The processing liquid 20 discharged from the discharging port of the liquid container 211 is returned into the tank 220 through the liquid discharging pipe 224 so that the processing liquid 20 is circulated. When the processing liquid 20 is steadily circulated, a liquid supplying amount of the liquid supplying pump 221, etc. are set such that the liquid interior belt conveying portion 212 is dipped into the processing liquid 20 within the liquid container 211.

The toner separating unit 3 has an offset belt 311, a heating block 314, an upper heating roller 315, a blowing fan 316, a cleaner 317 and a wiping roller 318. The offset belt 311 constitutes a separating member formed in the shape of a belt and wound around a plurality of supporting rollers 312, 313, etc. Each of the heating block 314 and the upper heating roller 315 has a heating lamp therein and is arranged such that the heating block 314 and the upper heating roller 315 come in press contact with each other through the offset belt 311. The blowing fan 316 constitutes a means for cooling toner attached onto a surface of the offset belt 311. The cleaner 317 removes the toner from the surface of the offset belt 311. The wiping roller 318 wipes the surface of the offset belt 311 after the offset belt 311 is cleaned by the cleaner 317. The wiping roller 318 also provides a predetermined tensile force to this offset belt 311.

The heating block 314 and the upper heating roller 315 make a toner image face of the transfer paper sheet 10 come in close contact with the offset belt 311. The heating block 314 and the upper heating roller 315 also heat and soften the toner fixed to the transfer paper sheet 10.

The offset belt 311 is formed by a material having adhesive force stronger than that between a surface of the transfer paper sheet 10 and the softened toner coming in contact with a contact side face of the offset belt 311. For example, the offset belt 311 is formed by a metallic material including aluminum, copper, nickel, etc., or a high molecular material such as polyethylene terephthalate (PET) having diffused titanium oxide.

A bending portion is formed on a downstream side in a moving direction of the offset belt 311 from a press contact portion between the heating block 314 and the upper heating roller 315. The bending portion has a predetermined radius of curvature and changes the moving direction of the offset belt 311 approximately 90 degrees. The moving direction of the offset belt 311 is rapidly changed around this bending portion so that the transfer paper sheet 10 is separated from the offset belt 311 by using curvature.

The blowing fan 316 cools toner on the offset belt 311 heated by the heating block 314, etc. and having large viscosity. Thus, the toner is solidified so that the toner is easily removed from the offset belt 311 by the cleaner 317.

The cleaner 317 mechanically separates and removes the attached toner from the surface of the offset belt 311 by a brush roller 319 having a metallic brush on a surface thereof. For example, this metallic brush is formed by a loop brush made of stainless steel. This brush roller 319 is biased toward the surface of the offset belt 311 by a pressurizing spring omitted in FIG. 15. A metallic blade may be arranged on a downstream side from this brush roller 319 in the moving direction of the offset belt 311.

The wiping roller 318 is formed by a material constructed such that at least a surface portion of this wiping roller 318 can have preferable wiping effects. For example, the wiping roller 318 is formed by winding a cloth, etc. around a circumferential face of a body of the wiping roller 318. In this example, no wiping roller 318 is normally rotated together with the surface of the offset belt 311 and a contact portion of the wiping roller 318 coming in contact with the surface of the offset belt 311 is changed by rotating the wiping roller 318 by a predetermined angle in suitable timing such that sufficient wiping effects of the wiping roller 318 are obtained for a long period. This construction of the wiping roller 318, etc. will be described later.

For example, the drying unit 4 dries the transfer paper sheet 10 such that a liquid holding amount of the transfer paper sheet 10 is equal to or smaller than 10% of paper weight. The drying unit 4 is constructed by a heating drum 411 and a belt 412 for pressing paper. For example, the heating drum 411 has a heating lamp therein and is made of aluminum. The paper pressing belt 412 is wound around a plurality of supporting rollers and is endlessly moved in a state in which the paper pressing belt 412 is wound around a circumferential face of the heating drum 411 by a predetermined angle. This paper pressing belt 412 can be constructed by a material having a heat resisting property and a gas permeable property. For example, this material is formed by using a cloth such as canvas texture, cotton texture, tetronic texture, etc.

The paper receiving unit 5 is constructed by a conveying roller pair 511, a branching claw 512, discharging roller pairs 513, 514, a built-in paper discharging tray 515, an unillustrated exterior paper discharging tray, etc. for conveying the transfer paper sheet 10 from the drying unit 4. The transfer paper sheet 10 can be selectively discharged onto the built-in paper discharging tray 515 or the exterior paper discharging tray in accordance with necessity. The built-in paper discharging tray 515 is slidably constructed such that the built-in paper discharging tray 515 can be pulled out on this side of the toner removing apparatus.

In the toner removing apparatus having the above construction, the processing liquid 20 is provided by the liquid providing unit 2 onto a toner image face of the transfer paper sheet 10 fed from the paper feed unit 1. For example, the toner image face of the transfer paper sheet 10 is set to a lower face thereof in FIG. 15. This transfer paper sheet 10 is then fed to the toner separating unit 3. Toner fixed onto the transfer paper sheet 10 is heated and softened by the heating block 314 and the upper heating roller 315 in this toner separating unit 3 so that this toner is attached onto a surface of the offset belt 311. When the transfer paper sheet 10 is separated from the offset belt 311 around the bending portion of the heating block 314, the toner attached to the surface of the offset belt 311 is separated from the transfer paper sheet 10 so that the toner is removed from the transfer paper sheet 10. The transfer paper sheet 10 removing the toner therefrom is then dried by the drying unit 4 and is discharged onto the built-in paper discharging tray 505 of the paper receiving unit 5 by the paper discharging roller pair 503. Thus, a liquid is supplied to the transfer paper sheet 10 attaching the toner thereto and the toner is separated from the transfer paper sheet 10 in a state in which this liquid permeates an interface portion between the toner and the transfer paper sheet 10. Accordingly, the toner can be removed from the transfer paper sheet 10 without damaging fibers of the transfer paper sheet 10.

With respect to the wiping roller 318, a one-way clutch is inserted into at least one of bearings 80*b* and 80*c* such that both shaft portions of the wiping roller 318 are rotatably supported by an unillustrated side plate of the toner removing apparatus and no wiping roller 318 is rotated together with the surface of the offset belt 311 moved and rotated in a normal direction shown by an arrow in FIG. 15. A driving roller 41 of the offset belt 311 can be rotated in a reverse direction to suitably rotate the wiping roller 318. In this construction, the wiping roller 318 comes in press contact with the surface of the offset belt 311 in a state in which the rotation of the wiping roller 318 caused by rotating the offset belt 311 is normally restricted by the above one-way clutch and is stopped. Accordingly, the wiping roller 318 sufficiently comes in frictional contact with the surface of the offset belt 311 so that the wiping roller 318 also wipes off paper powder, a brushing component of the brush roller 50, etc. This brushing component includes copper and zinc when brass is used as the brush roller 50. The driving roller 41 is reversely rotated by a constant angle in timing in which no transfer paper sheet 10 is fed from the liquid supplying unit 30 to a pressurizing portion between the upper heating roller 315 and a portion of the offset belt 311 moved by backup of at least the heating block 314. For example, the driving roller 4 is reversely rotated by a constant angle after a series of transfer paper sheets 10 has passed through this pressurizing portion. Then, the offset belt 311 is reversely moved by a constant amount. The wiping roller 318 is rotated by a constant amount in the direction of an arrow B by this reverse movement of the offset belt 311. For example, this constant amount of the wiping roller 318 is set to 60°. Thus, a contact portion of the wiping roller 318 coming in contact with the offset belt 311 is changed so that a new face of the wiping roller 318 comes in contact with this offset belt 311.

As mentioned above, in accordance with a first, second, eighth or ninth construction of the present invention, it is detected whether an unremoved image unremovable from an image holding member by removing processing of an image forming substance is left on the image holding member or not. A mark for discrimination is added to the image holding member on the basis of detected results of an existence or nonexistence of the unremoved image. The image holding member having the unremoved image is easily discriminated by this discriminating mark from an image holding member completely removing the image forming substance therefrom. Accordingly, it is possible to prevent the image holding member having the unremoved image from being reused in error by discriminating this image holding member. Further, it is possible to prevent the image holding member having the unremoved image from being thrown away in error. Accordingly, a leakage of secret information can be prevented in advance and it is possible to prevent the image holding member having the unremoved image such as a stamp, a signature, etc. from being abused, altered and forged in advance.

In accordance with a third construction of the present invention, the above discriminating mark is additionally provided in a position in which the unremoved image on the image holding member is left. Accordingly, no unremoved image can be recognized by this discriminating mark. Therefore, when the image holding member is thrown away in error, etc., a leakage of secret information can be further prevented in advance and it is possible to further prevent the image holding member having the unremoved image such as a stamp, a signature, etc. from being abused, altered and forged in advance.

In accordance with a fourth, fifth, sixth, eighth or ninth construction of the present invention, it is detected whether an unremoved image such as a seal print unremovable by removing processing of the image forming substance is left on the image holding member or not. When the unremoved image is left on the image holding member, the toner removing apparatus is operated such that no unremoved image can be recognized. For example, this seal print is blotted. Thus, when the image holding member is thrown away in error, etc., no unremoved image can be recognized on the image holding member. Accordingly, it is possible to prevent the image holding member having the unremoved image from being abused, altered and forged in advance.

In accordance with a seventh construction of the present invention, the operation of a means for sorting the separated image holding member is controlled on the basis of detected results of an existence or nonexistence of the unremoved image detected by the above detecting means. Thus, the image holding member having the unremoved image can be automatically discriminated from an image holding member completely removing the image forming substance therefrom. Accordingly, it is not necessary to manually perform a sorting operation for subsequent processings about necessariness or unnecessariness of reuse, paper cutting for holding secret information, etc.

Many widely different embodiments of the present invention may be constructed without departing from the spirit and scope of the present invention. It should be understood that the present invention is not limited to the specific embodiments described in the specification, except as defined in the appended claims.

What is claimed is:

1. An apparatus for removing an image forming substance from an image holding member, comprising:

image forming substance removing means for removing the image forming substance from the image holding member;

detecting means for detecting whether or not there is an unremoved image unremovable from the image holding member by the removing processing of the image forming substance removing means before or after this removing processing;

discriminating mark providing means for additionally providing a discriminating mark for discriminating an existence or nonexistence of the unremoved image to the image holding member; and control means for controlling an operation of the discriminating mark providing means on the basis of detected results of the existence or nonexistence of the unremoved image obtained by the detecting means.

2. An apparatus for removing an image forming substance from an image holding member, comprising:

image forming substance removing means for removing the image forming substance from the image holding member;

detecting means for detecting whether or not there is an unremoved image unremovable from the image holding member by the removing process of the image forming substance removing means before or after this removing process;

discriminating mark providing means for additionally providing a discriminating mark for discriminating an existence or nonexistence of the unremoved image to the image holding member;

control means for controlling an operation of the discriminating mark providing means on the basis of detected results of the existence or nonexistence of the unremoved image obtained by the detecting means;

sorting means for sorting the image holding member after the removing processing of said image forming substance; and control means for controlling an operation of the sorting means on the basis of the detected results of the existence or nonexistence of the unremoved image obtained by said detecting means.

3. An apparatus for removing an image forming substance from an image holding member, comprising:

image forming substance removing means for removing the image forming substance from the image holding member;

detecting means for detecting whether or not there is an unremoved image unremovable from the image holding member by the removing process of the image forming substance removing means before or after this removing processing;

discriminating mark providing means for additionally providing a discriminating mark for discriminating an existence or nonexistence of the unremoved image to the image holding member; and control means for controlling an operation of the discriminating mark providing means on the basis of detected results of the existence or nonexistence of the unremoved image obtained by the detecting means;

wherein said image forming substance removing means has:

unstabilizing agent providing means for providing an unstabilizing agent to said image holding member;

the unstabilizing agent changing an attaching state between the image holding member and said image forming substance to an unstable state; and separating means for separating and removing the image forming substance from the image holding member by making a separating member come in contact with the image forming substance in the unstable state.

4. An apparatus for removing an image forming substance from an image holding member, comprising:

image forming substance removing means for removing the image forming substance from the image holding member;

detecting means for detecting whether or not there is an unremoved image unremovable from the image holding member by the removing processing of the image forming substance removing means before or after this removing processing;

unrecognizing means for rendering unrecognizable all or a portion of the unremoved image; and control means for controlling an operation of the unrecognizing means on the basis of detected results of an existence or nonexistence of the unremoved image obtained by the detecting means.

5. An apparatus for removing an image forming substance from an image holding member, comprising:

image forming substance removing means for removing the image forming substance from the image holding member;

detecting means for detecting whether or not there is an unremoved image unremovable from the image holding member by the removing processing of the image forming substance removing means before or after this removing processing;

unrecognizing means for rendering unrecognizable all or a portion of the unremoved image;

control means for controlling an operation of the unrecognizing means on the basis of detected results of an existence or nonexistence of the unremoved image obtained by the detecting means;

wherein said detecting means has seal print detecting means for detecting an existence or nonexistence of a seal print on said image holding member; and said unrecognizing means has a seal print invalidating device for blotting the seal print.

6. An apparatus for removing an image forming substance from an image holding member, comprising:

image forming substance removing means for removing the image forming substance from the image holding member;

detecting means for detecting whether or not there is an unremoved image unremovable from the image holding member by the removing processing of the image forming substance removing means before or after this removing processing;

unrecognizing means for rendering unrecognizable all or a portion of the unremoved image;

control means for controlling an operation of the unrecognizing means on the basis of detected results of an existence or nonexistence of the unremoved image obtained by the detecting means;

sorting means for sorting the image holding member after the removing processing of said image forming substance; and control means for controlling an operation of the sorting means on the basis of the detected results of the existence or nonexistence of the unremoved image obtained by said detecting means.

7. An apparatus for removing an image forming substance from an image holding member, comprising:

image forming substance removing means for removing the image forming substance from the image holding member;

detecting means for detecting whether or not there is an unremoved image unremovable from the image holding member by the removing processing of the image forming substance removing means before or after this removing processing;

unrecognizing means for rendering unrecognizable all or a portion of the unremoved image; and control means for controlling an operation of the unrecognizing means on the basis of detected results of an existence or nonexistence of the unremoved image obtained by the detecting means;

wherein said image forming substance removing means has:

unstabilizing agent providing means for providing an unstabilizing agent to said image holding member;

the unstabilizing agent changing an attaching state between the image holding member and said image forming substance to an unstable state; and separating means for separating and removing the image substance from the image holding member by making a separating member cone in contact with the image forming substance in the unstable state.

8. An apparatus for recycling an image-bearing support material, at least a part of said image-bearing support material comprising a material with cellulose fibers as a main component and having an image forming substance stably fixed on the material comprising:

image forming substance removing means for removing the image forming substance from the image-bearing support material;

detecting means for detecting whether or not there is an unremoved image unremovable from the image-bearing support material by the removing processing of the image forming substance removing means before or after this removing processing;

discriminating mark providing means for additionally providing a discriminating mark for discriminating an existence or nonexistence of the unremoved image to the image-bearing support material; and control means for controlling an operation of the discriminating mark providing means on the basis of detected results of the existence or nonexistence of the unremoved image obtained by the detecting means.

9. An apparatus as claimed in claim 8, wherein said discriminating mark is additionally provided in a position in which the unremoved image is left on said image-bearing support material.

10. An apparatus as claimed in claim 8, wherein said discriminating mark providing means has a blotting device for rendering unrecognizable said unremoved image print.

11. An apparatus as claimed in claim 8, wherein said discriminating mark providing means has a punching device for punching a hole as the discriminating mark in the image-bearing support material.

12. An apparatus as claimed in claim 8, wherein said discriminating mark providing means has a cutter device for cutting a portion of the image-bearing support material.

13. An apparatus for recycling an image-bearing support material, at least a part of said image-bearing support material comprising a material with cellulose fibers as a main component and having an image forming substance stably fixed on the material, comprising:

image forming substance removing means for removing the image forming substance from the image-bearing support material;

detecting means for detecting whether or not there is an unremoved image unremovable from the image-bearing support material by the removing processing of the image forming substance removing means before or after this removing processing;

unrecognizing means for rendering unrecognizable all or a portion of the unremoved image; and control means for controlling an operation of the unrecognizing means on the basis of detected results of an existence or nonexistence of the unremoved image obtained by the detecting means.

14. An apparatus as claimed in claim 13, wherein said unrecognizing means has a punching device for punching a hole as the discriminating mark in the image-bearing support material.

15. An apparatus as claimed in claim 14, wherein said unrecognizing means has an unremoved image invalidating device for blotting said unremoved image.

16. An apparatus as claimed in claim 13, wherein said unrecognizing means has a cutter device for cutting a portion of the image-bearing support material.

* * * * *